US009457590B2

(12) United States Patent
Koizumi et al.

(10) Patent No.: US 9,457,590 B2
(45) Date of Patent: Oct. 4, 2016

(54) PRINTING APPARATUS, METHOD FOR CONTROLLING PRINTING APPARATUS, AND STORAGE MEDIUM

(71) Applicant: CANON KABUSHIKI KAISHA, Tokyo (JP)

(72) Inventors: Kazuya Koizumi, Tama (JP); Yasutaka Mitani, Tokyo (JP); Yosuke Ushigome, Yokohama (JP); Yoshiaki Kaburagi, Kawasaki (JP); Takayuki Tanabe, Kawasaki (JP); Atsushi Takahashi, Kawasaki (JP); Yusuke Kadokura, Sagamihara (JP); Keiji Harada, Yokohoma (JP); Yoshiaki Takayanagi, Tokyo (JP); Hideo Horigome, Yokohama (JP); Susumu Hirosawa, Tokyo (JP); Atsushi Sakamoto, Yokohama (JP); Satoshi Masuda, Yokohama (JP); Toshiki Takeuchi, Tokyo (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/666,737

(22) Filed: Mar. 24, 2015

(65) Prior Publication Data

US 2015/0273896 A1 Oct. 1, 2015

(30) Foreign Application Priority Data

Mar. 27, 2014 (JP) ..... 2014-067118
Jul. 8, 2014 (JP) ..... 2014-140274

(51) Int. Cl.
*B41J 3/60* (2006.01)
*B41J 2/045* (2006.01)

(Continued)

(52) U.S. Cl.
CPC ..... *B41J 3/60* (2013.01); *B41J 2/0458* (2013.01); *B41J 2/04505* (2013.01);

(Continued)

(58) Field of Classification Search
CPC .... B41J 3/60; B41J 2/04581; B41J 2/04578; B41J 2/04505; B41J 2/0458; B41J 2/04573; B41J 11/42; B41J 11/008
USPC ..... 347/10
See application file for complete search history.

(56) References Cited

U.S. PATENT DOCUMENTS 6,267,518 B1 * 7/2001 Abe ..... B41J 3/4078 347/3
6,608,985 B2 * 8/2003 Mochimaru ..... G03G 15/232 399/306

(Continued)

FOREIGN PATENT DOCUMENTS

EP 1520717 A1 4/2005
EP 2399750 A1 12/2011

(Continued)

OTHER PUBLICATIONS

Extended European Search Report in European Patent Application No. 15161085.4, dated Sep. 9, 2015.

(Continued)

*Primary Examiner* — Julian Huffman
*Assistant Examiner* — Michael Konczal
(74) *Attorney, Agent, or Firm* — Fitzpatrick, Cella, Harper & Scinto

(57) ABSTRACT

There are provided a printing apparatus, a method for controlling the printing apparatus, and a storage medium. The printing apparatus includes a conveying unit that conveys a print medium; a print head that applies a color material on the print medium; an obtaining unit configured to obtain, in the case where a first surface of the print medium on which a first image is printed comes in contact with the conveying unit, information on a printing condition of the first surface that becomes a factor of changing a conveying speed of the print medium in the predetermined direction; and a control unit configured to control timing of applying a color material on a second surface of the print medium that is a surface at the opposite to the first surface according to the printing condition indicated by the information obtained by the obtaining unit.

14 Claims, 33 Drawing Sheets

(51) Int. Cl.
*B41J 11/00* (2006.01)
*B41J 11/42* (2006.01)

(52) U.S. Cl.
CPC ..... *B41J 2/04573* (2013.01); *B41J 2/04578* (2013.01); *B41J 2/04581* (2013.01); *B41J 11/008* (2013.01); *B41J 11/42* (2013.01)

(56) References Cited

U.S. PATENT DOCUMENTS

| | | | | |
|---|---|---|---|---|
| 7,168,775 | B2 | 1/2007 | Kuruma et al. | |
| 7,296,872 | B2 | 11/2007 | Hayashi et al. | |
| 7,760,370 | B2 * | 7/2010 | Oki | H04N 1/0058 358/1.1 |
| 7,850,273 | B2 | 12/2010 | Yasutani et al. | |
| 7,984,905 | B2 * | 7/2011 | Yasumoto | B65H 7/06 271/227 |
| 8,079,659 | B2 | 12/2011 | Tajika et al. | |
| 8,186,783 | B2 | 5/2012 | Yasutani et al. | |
| 8,251,479 | B2 | 8/2012 | Seki et al. | |
| 8,348,372 | B2 | 1/2013 | Chikuma et al. | |
| 8,585,174 | B2 * | 11/2013 | Saita | B41J 2/2142 347/19 |
| 9,100,611 | B2 * | 8/2015 | Kishi | G03G 15/5062 |
| 2008/0019727 | A1 * | 1/2008 | Honma | B41J 3/60 399/82 |
| 2011/0134178 | A1 | 6/2011 | Chiwata | |
| 2014/0049575 | A1 * | 2/2014 | Leighton | B41J 29/38 347/14 |
| 2015/0062225 | A1 | 3/2015 | Sakamoto et al. | |

FOREIGN PATENT DOCUMENTS

| | | | |
|---|---|---|---|
| JP | 2005-059495 | A | 3/2005 |
| JP | 2011-121237 | A | 6/2011 |
| JP | 2011-183752 | A | 9/2011 |

OTHER PUBLICATIONS

U.S Appl. No. 14/645,929, filed Mar. 12, 2015, Kengo Nieda.

* cited by examiner

| FRONT SURFACE IMAGE PRINT DUTY (%) | PARAMETER FOR CALCULATION PRINT CLOCK CORRECTION VALUE |
|---|---|
| 0 | CONVEYING SPEED CHANGING INFORMATION 0 |
| 1 | CONVEYING SPEED CHANGING INFORMATION 1 |
| 2 | CONVEYING SPEED CHANGING INFORMATION 2 |
| . | . |
| . | . |
| . | . |
| 99 | CONVEYING SPEED CHANGING INFORMATION 99 |
| 100 | CONVEYING SPEED CHANGING INFORMATION 100 |

FIG.9

PRINT CLOCK INFORMATION STORAGE MEMORY

| ADDRESS | KIND |
|---|---|
| 0xB003_8000 | PRINT CLOCK CORRECTION VALUE 0 |
| 0xB003_8004 | PRINT CLOCK CORRECTION VALUE 1 |
| 0xB003_8008 | PRINT CLOCK CORRECTION VALUE 2 |
| . | |
| . | |
| . | |
| 0xB003_CFFC | PRINT CLOCK CORRECTION VALUE * |
| 0xB003_D000 | PRINT CLOCK CORRECTION VALUE * |

FIG.10A

PRINT CLOCK CORRECTION VALUE

| DETAIL | DETAIL |
|---|---|
| COLUMN NUMBER (3 BITS) | COLUMN NUMBER PER SLIT |
| LATCH INTERVAL (9 BITS) | INTERVAL BETWEEN LATCH TRIGGERS |
| DELAY TIME (14 BITS) | DELAY TIME |

FIG.10B

SHIFT AMOUNT (FIRST CORRECTION VALUE FOR BACK SURFACE)

SECOND CORRECTION VALUE DETERMINATION TABLE

| | PRINT DUTY OF FRONT SURFACE IMAGE | | | | | |
|---|---|---|---|---|---|---|
| | 100% | 80% | 60% | 40% | 20% | 0% |
| 10μm | 13μm | 12μm | 11μm | 10μm | 9μm | 8μm |
| 20μm | 25μm | 23μm | 21μm | 19μm | 17μm | 15μm |
| 30μm | 38μm | 35μm | 32μm | 29μm | 26μm | 23μm |
| 40μm | 50μm | 46μm | 42μm | 38μm | 34μm | 30μm |
| 50μm | 63μm | 58μm | 53μm | 48μm | 43μm | 38μm |
| 60μm | 75μm | 69μm | 63μm | 57μm | 51μm | 45μm |
| 70μm | 88μm | 81μm | 74μm | 67μm | 60μm | 53μm |
| 80μm | 100μm | 92μm | 84μm | 76μm | 68μm | 60μm |
| 90μm | 113μm | 104μm | 95μm | 86μm | 77μm | 68μm |
| 100μm | 125μm | 115μm | 105μm | 95μm | 85μm | 75μm |

FIG.28

PRINTING APPARATUS, METHOD FOR CONTROLLING PRINTING APPARATUS, AND STORAGE MEDIUM

BACKGROUND OF THE INVENTION

1. Field of the Invention

The present invention relates to a printing apparatus, a method for controlling the printing apparatus, and a storage medium, and in particular, to a printing apparatus, a method for controlling the printing apparatus, and a storage medium that suppress a print position shift due to a change in friction coefficient between a print medium and a conveying unit.

2. Description of the Related Art

In a printing apparatus, an image is printed on a print medium by applying a color material on the print medium from a print head and conveying the print medium. An example of the conveying system of the print medium includes a roller conveying system of nipping and conveying the print medium between a conveying roller and a pinch roller driven thereby, and the like. In addition, some of the printing apparatuses perform a double-sided print in which an image is printed on one surface (hereinafter, referred to as "front surface") of the print medium and then, an image is printed on the other surface (hereinafter, referred to as "back surface") thereof.

In the double-sided print, in the case where there occurs a change (extension/contraction or the like) in state of the print medium due to application of the color material on the front surface at the printing thereon, in some cases a difference occurs in an image size between the front surface and the back surface. For prevention of this occurrence, a printing apparatus disclosed in Japanese Patent Laid-Open No. 2011-121237 estimates a change amount of the print medium based upon image data of the front surface and corrects at least one of the image data of the front surface and the image data of the back surface based upon the estimated telescopic amount.

At the double-sided printing, in the case where a change in the state of the print medium occurs by printing an image on the front surface, a friction coefficient between the print medium and the conveying roller changes between the printing time of the front surface and the printing time of the back surface to change a conveying force of the conveying roller, and therefore the conveying speed of the print medium may change. As a result, there are some cases where the print position is shifted from a desired position at the back surface printing after the front surface printing.

In the printing apparatus according to Japanese Patent Laid-Open No. 2011-121237, the extension/contraction of the print medium is estimated to correct the image data, and thereby the dimension difference between the front and back-surface images is suppressed. Therefore in some cases it is not possible to appropriately suppress the print position shift at the back surface printing after the front surface printing due to the change in conveying speed of the print medium caused by the change in friction coefficient between the print medium and the conveying roller.

SUMMARY OF THE INVENTION

The present invention provides a printing apparatus, a method for controlling the printing apparatus, and a storage medium that can suppress a print position shift due to a change in friction coefficient between a print medium and a conveying unit at a double-sided print.

According to a first aspect of the present invention, a printing apparatus includes:

a conveying unit configured to convey a print medium;

a print head configured to apply a color material on the print medium conveyed by the conveying unit in a predetermined conveying direction;

an obtaining unit configured to obtain, in the case where a first surface of the print medium on which a first image is printed comes in contact with the conveying unit, information on a printing condition of the first surface that becomes a factor of changing a conveying speed of the print medium in the predetermined direction; and a control unit configured to control timing of applying a color material on a second surface of the print medium that is a surface at the opposite to the first surface according to the printing condition indicated by the information obtained by the obtaining unit at the time of printing a second image on the second surface.

According to a second aspect of the present invention, a method for controlling a printing apparatus includes:

a conveying unit configured to convey a print medium; and a print head configured to apply a color material on the print medium conveyed by the conveying unit in a predetermined conveying direction, the method including the steps of:

in the case where a first surface of the print medium on which a first image is printed comes in contact with the conveying unit, obtaining information on a printing condition of the first surface associated with a factor of changing a conveying speed of the print medium; and controlling timing of applying a color material on a second surface of the print medium that is a surface at the opposite to the first surface according to the printing condition indicated by the information obtained in the obtaining step at the time of printing a second image on the second surface.

According to a third aspect of the present invention, there is provided a storage medium that stores a program causing a computer to execute the method for controlling the printing apparatus.

According to the above configuration, the applying timing of the color material at the time of printing the image on the second surface of the print medium is controlled according to the printing condition of the first surface that becomes the factor of changing the conveying speed of the print medium in the case where the first surface of the print medium comes in contact with the conveying unit. Therefore even in the case where the friction coefficient between the print medium and the conveying unit differs between the printing time of the first image on the first surface and the printing time of the second image on the second surface, and the conveying speed of the print medium changes, it is possible to suppress the print position shift due thereto.

Further features of the present invention will become apparent from the following description of exemplary embodiments (with reference to the attached drawings).

BRIEF DESCRIPTION OF THE DRAWINGS

FIG. 9 is a diagram illustrating a table used in calculating print clock correction values;

FIG. 10A is a chart illustrating the details of print clock information;

FIG. 10B is a chart illustrating the details of print clock correction values;

FIG. 28 is a diagram illustrating an example of a table for determining a second correction value;

DESCRIPTION OF THE EMBODIMENTS

Hereinafter, embodiments according to the present invention will be in detail described with reference to the accompanying drawings.

(First Embodiment)

Figure 1:
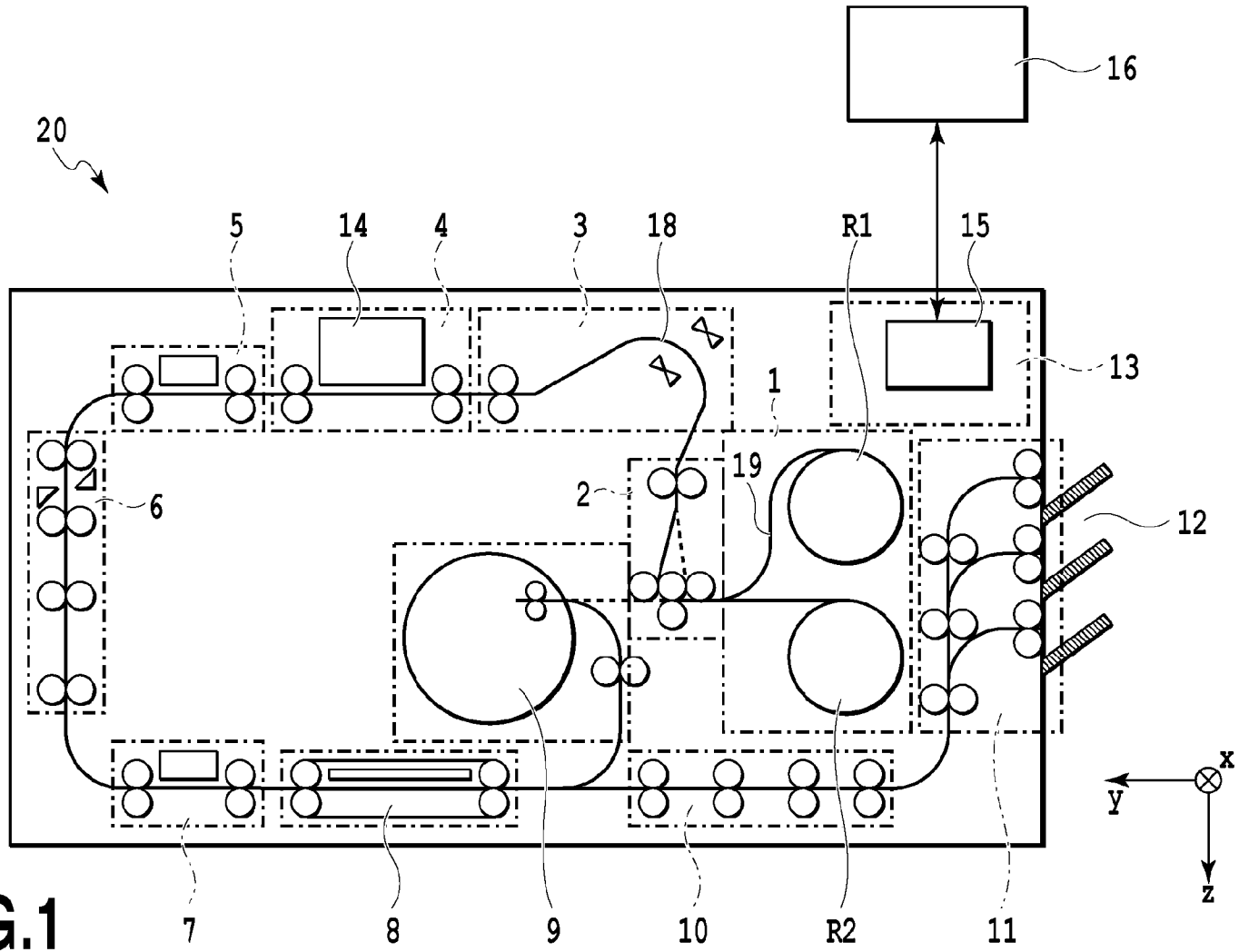
FIG. 1 is a sectional view illustrating the interior configuration of an inkjet printing apparatus.

FIG. 1 is a sectional view illustrating the interior configuration of an inkjet printing apparatus 20. As illustrated in the same figure, the inkjet printing apparatus 20 (hereinafter, referred to as "printing apparatus 20") is connected to a host apparatus 16. In the present embodiment, the host apparatus 16 supplies image data to the printing apparatus 20. The printing apparatus 20 prints an image on a print medium based upon the image data received from the host apparatus 16.

The printing apparatus 20 includes a paper feeder 1, a decal unit 2, an oblique-pass correcting unit 3, a printing unit 4, an inspection unit 5, a cutter unit 6, an information printing unit 7, a drying unit 8, a rewinding unit 9, a discharge conveying unit 10, a sorter unit 11, a discharge tray 12 and a control unit 13. The control unit 13 is provided with a controller part 15 and a power source part (not shown). The control unit 13 controls the respective units in the printing apparatus 20. The controller part 15 receives image data from the host apparatus 16. The power source part supplies power to the respective components in the printing apparatus 20. In addition, the printing apparatus 20 is provided with a conveying mechanism including a plurality of paired rollers and a belt, and the print medium is conveyed along a conveyance path 18 by the conveying mechanism.

The paper feeder 1 accommodates therein the print medium in a roll shape that is wound on roll R1 and roll R2 and pulls out the print medium from roll R1 or roll R2 to be supplied to the decal unit 2. In the present embodiment, the paper feeder 1 accommodates two rolls of roll R1 and roll R2 therein, but the number of the rolls that are accommodated therein is not limited to two, but one, three or more rolls may be accommodated therein.

The decal unit 2 reduces a curl of the print medium supplied from the paper feeder 1. The oblique-pass correcting unit 3 corrects an oblique movement (inclination to an original forward direction) of the print medium that has passed the decal unit 2. The print medium the oblique movement of which is corrected at the oblique-pass correcting unit 3 is conveyed to the printing unit 4.

The printing unit 4 prints an image on the print medium. The printing unit 4 prints also various patterns such as a cut mark pattern for confirming a cutting position of the print medium. A plurality of inkjet print heads are arranged in the printing unit 4. The print head in the present embodiment is a full-line type print head and has a length corresponding to a width of the print medium in the maximum size that is supposed to be use. The print head is arranged in such a manner that a direction crossing a conveying direction of the print medium is made a longitudinal direction thereof. In the present specification, print heads 14*a* to 14*g* to be described later are collectively called "print head 14".

In the present embodiment, the printing apparatus 20 uses seven print heads. Ink tanks (not shown) are connected to the print heads 14*a* to 14*g* to be capable of supplying the corresponding inks respectively thereto. Each of the inks is supplied to each of the print heads from each of the associated ink tanks through each ink tube (not illustrated). In the present embodiment, the inks of C (cyan), M (magenta), Y (yellow), LC (light cyan), LM (light magenta), G (gray), and K (black) are accommodated in the ink tanks respectively.

Although not illustrated, a plurality of nozzles are formed on a surface of the print head 14 opposing the print medium with each other, and the plurality of nozzles form a nozzle array. Ink is ejected from each of the nozzles. In regard to the inkjet type, a type using a heater element, a type using a piezo element, a type using an electrostatic element, and a type using an MEMS element and the like may be adopted. In the present embodiment, a heater element is used as an energy generating element (print element) that generates energy for ejecting ink from the nozzle. In the present embodiment, a drive cycle of the print element at the time of printing an image on one surface of the print medium is changed according to a print duty of an image printed on the other surface at the opposite to the one surface, and thereby, ejection timing of the ink at the time of printing the image on the one surface is controlled.

The inspection unit 5 has a scanner, and this scanner reads the image and various patterns that are printed on the print medium by the printing unit 4. The inspection unit 5 is provided with a CPU (not illustrated) for analysis of the read result. The inspection unit 5 analyses the read information by the CPU to determine an ejection state of the nozzle in the print head 14, a conveying state of the print medium, and a print position thereon, and the like.

The scanner is provided with a light-emitting unit and an imaging element that are not illustrated. The light-emitting unit is arranged in a position of emitting light toward a reading direction of the imaging element or in a position of emitting light toward the imaging element in the state of placing the print medium between the light-emitting unit and the imaging element. In the case of the former, the imaging element receives reflected light of the light emitted from the light-emitting unit, and in the case of the latter, the imaging element receives light that has transmitted the print medium out of the light emitted from the light-emitting unit. The imaging element converts the received light into an electrical signal and outputs the electrical signal.

In the present embodiment, a charged coupled device (CCD) image sensor is used as the imaging element. In addition, an explanation will be made of the case of using line sensors composed of CCD sensors provided along a direction (nozzle-array direction of the print head 14) crossing the conveying direction of the print medium, but sensors other than the CCD line sensor may be used.

The cutter unit 6 cuts the print medium on which an image is printed at the printing unit 4 to a predetermined length. The information printing unit 7 prints information such as serial numbers and dates as needed on the print medium that is cut to the predetermined length at the cutting unit 6. The drying unit 8 heats the print medium to dry ink and the like applied to the print medium. The rewinding unit 9 temporarily rewinds the print medium on one surface of which the printing is completed at the time of performing a double-sided print onto the print medium. Then the rewound print medium is again conveyed to the printing unit 4 such that ink is applied on a surface different from the one surface on which the printing is completed. The details of the one-sided printing and the double-sided printing will be described later.

The discharge conveying unit 10 conveys the print medium that is dried at the drying unit 8 to the sorter unit 11. The sorter unit 11 discharges the print medium to the discharge tray 12. The sorter unit 11 sorts the print mediums as needed, and distributes the sorted print mediums to a plurality of the trays in the discharge tray 12. The sorted print mediums that are distributed and discharged from the sorter unit 11 are respectively placed on the plurality of trays provided in the discharge unit 12.

Figure 2:
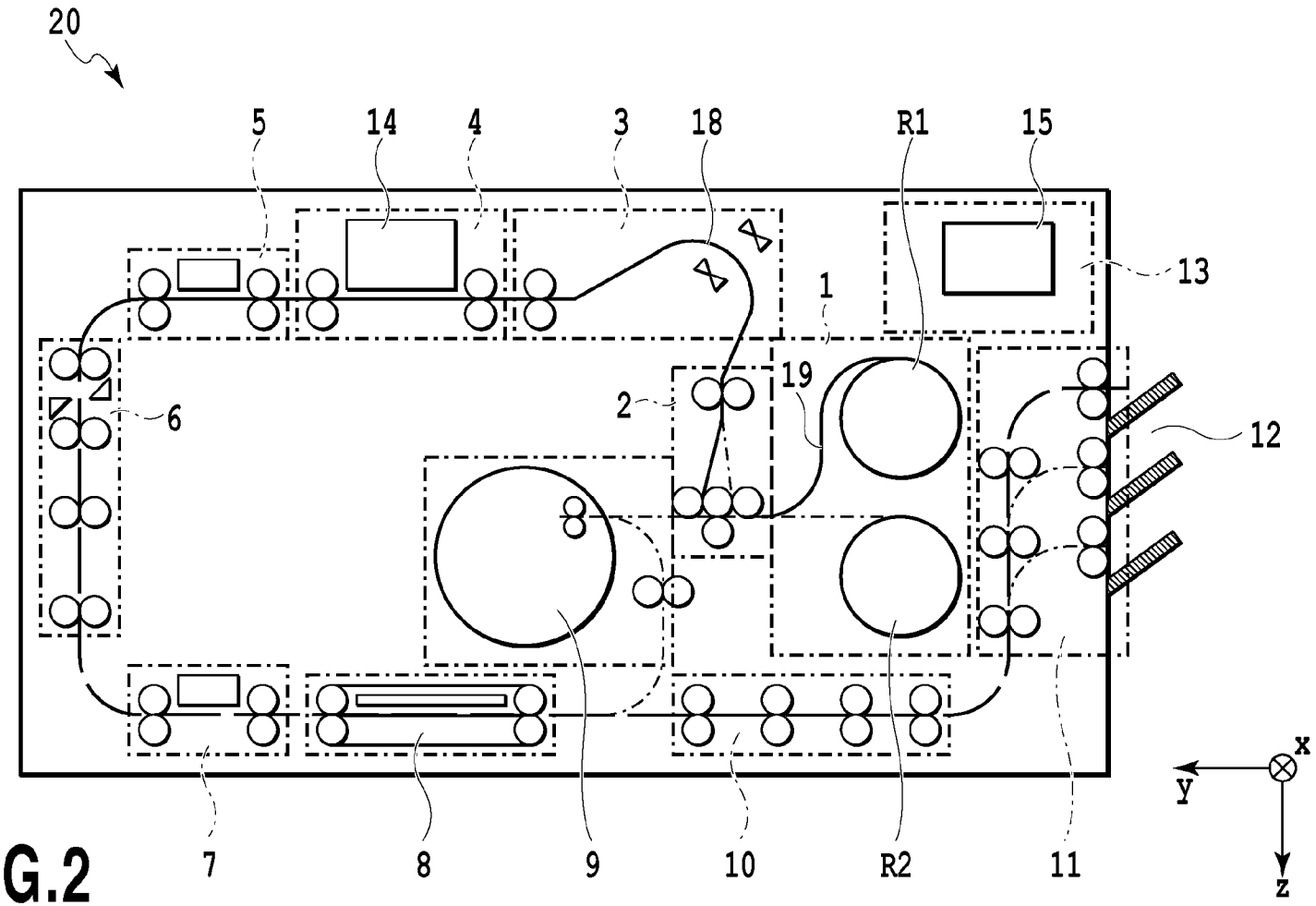
FIG. 2 is a sectional view illustrating the interior configuration of the inkjet printing apparatus for explaining an operation at one-sided printing.

FIG. 2 is a sectional view illustrating the interior configuration of the printing apparatus 20 for explaining an operation at the one-sided printing. The print medium 19 fed from the paper feeder 1 goes through the decal unit 2 and the oblique-pass correcting unit 3 to the printing unit 4, and then at the printing unit 4, ink is applied on the opposing surface of the print medium 19 to the surface on which the nozzles of the print head 14 are provided to print an image thereon. The print medium 19 on which the image is printed goes through the inspection unit 5, and is cut to a predetermined length at the cutting unit 6. The information is printed on the backside of the print surface of the cut print medium 19 as needed. Then, the print medium 19 is dried at the drying unit 8, and goes through the discharge conveying unit 10 and the sorter unit 11, and is discharged to the discharge tray 12.

Figure 3:
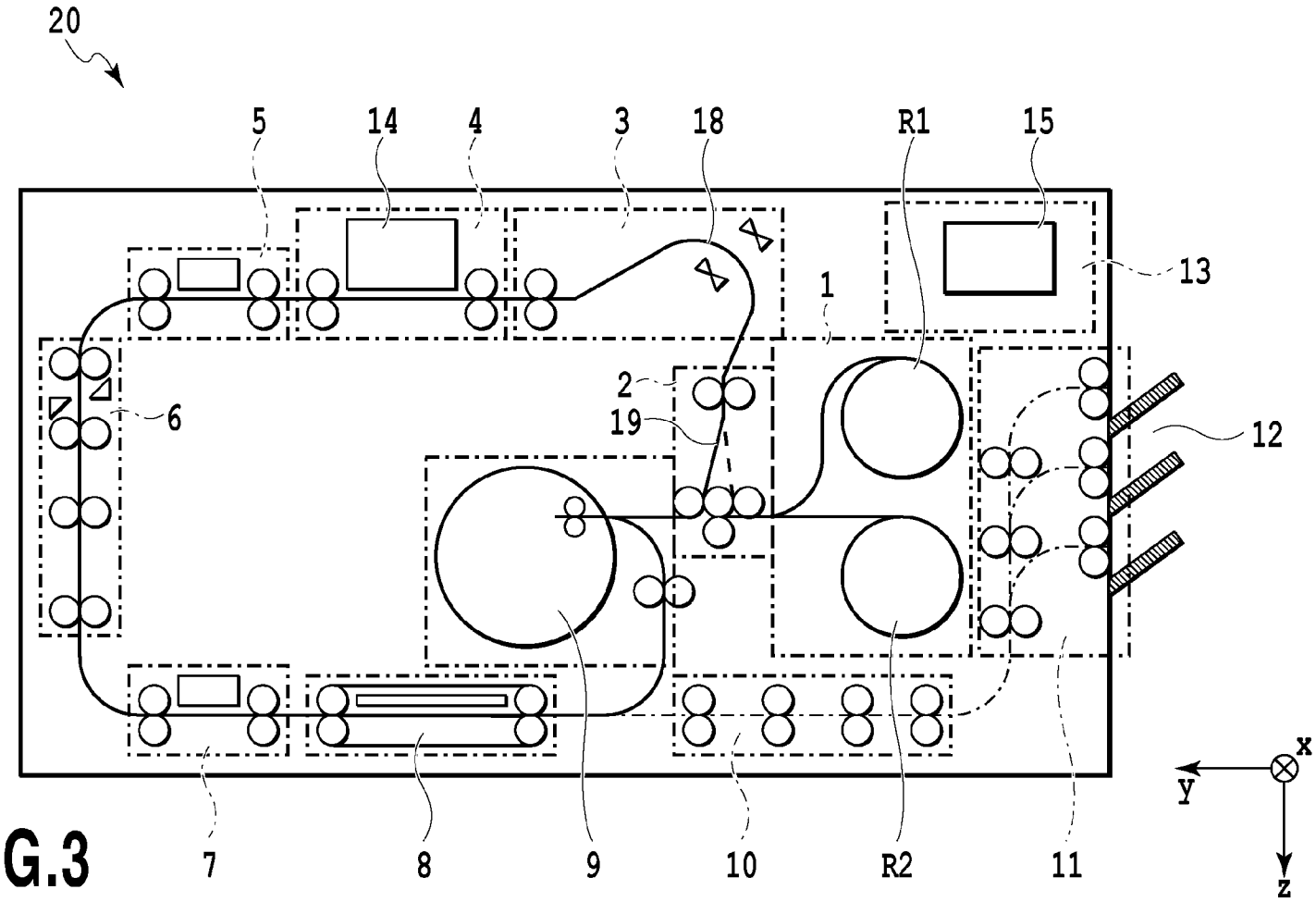
FIG. 3 is a sectional view illustrating the interior configuration of the inkjet printing apparatus for explaining an operation at double-sided printing.

FIG. 3 is a sectional view illustrating the interior configuration of the printing apparatus 20 for explaining an operation at the double-sided printing. The operation at the time the print medium 19 is conveyed from the paper feeder 1 to the inspection unit 5 is similar to the operation at the aforementioned one-sided printing. In the double-sided printing, the print medium 19 is not cut at the cutting unit 6 until all the printing on a first surface of the print medium 19 is completed.

The print medium 19 is conveyed to the drying unit 8 without the printing of the information at the information printing unit 7. The print medium 19 dried at the drying unit 8 is rewound by a rewinding drum of the rewinding unit 9. When all the printing on the first surface is completed, the print medium 19 is cut at the cutting unit 6. The print medium 19 positioned downstream in the conveying direction from the cutting position is all rewound at the rewinding unit 9, and the print medium 19 positioned upstream in the conveying direction from the cutting position is all rewound at the paper feeder 1.

When the above operation is completed, the backside of the first surface is printed. The print medium 19 is fed to the decal unit 2 by rotating the rewinding drum of the rewinding unit 9 in a reverse direction to a rotating direction at the rewinding time.

The print medium 19 is fed to the printing unit 4 through the decal unit 2 and the oblique-pass correcting unit 3, and at the printing unit 4, the image is printed on the backside of the first surface. The print medium 19 on which the image is printed is conveyed to the cutting unit 6 through the inspection unit 5, and is cut to a predetermined length at the cutting unit 6. Since the print medium 19 cut to the predetermined length is printed on both the surfaces, the print medium 19 is dried at the drying unit 8 without the printing of the information at the information printing unit 7, and is discharged to the discharge tray 12 through the discharge conveying unit 10 and the sorter unit 11.

Figure 4:
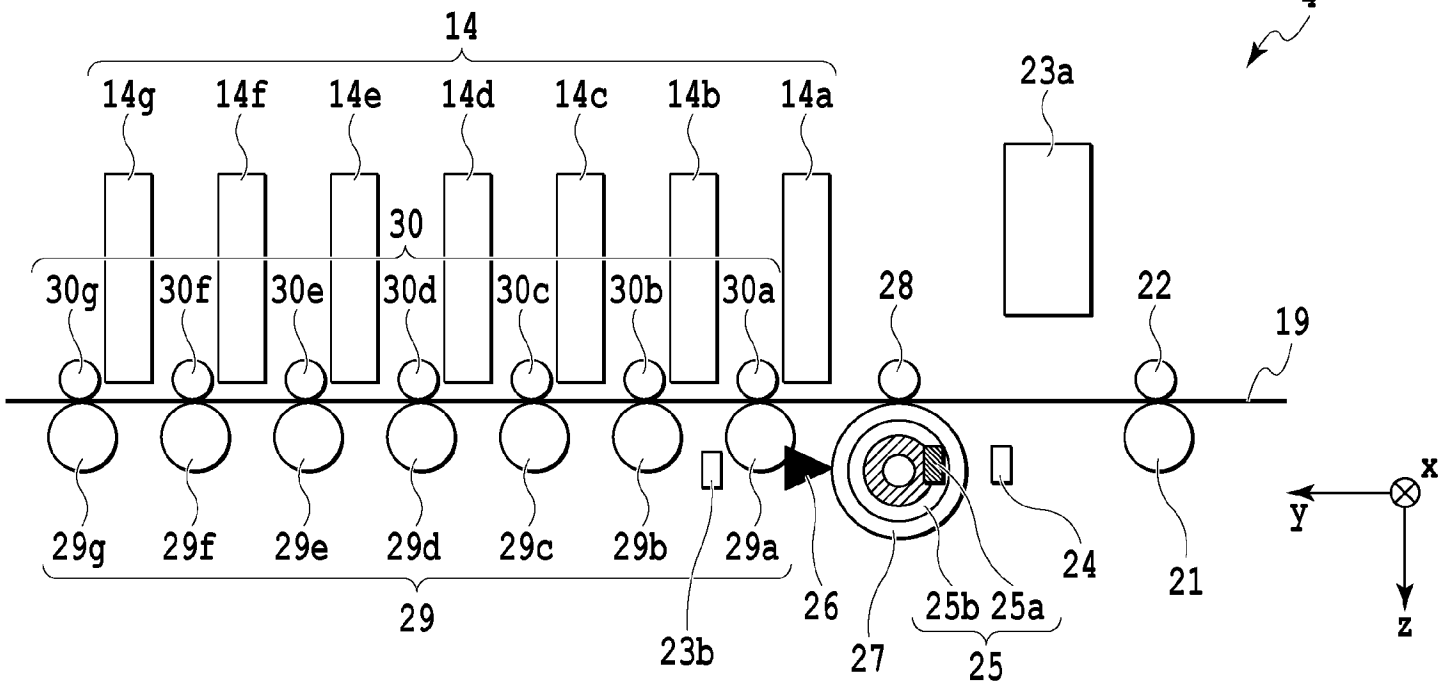
FIG. 4 is a sectional view illustrating the configuration of a printing unit and the surroundings.

FIG. 4 is a sectional view illustrating the configuration of the printing unit 4 and the surroundings. As illustrated in FIG. 4, a main roller pair included a main conveying roller 27 and a main pinch roller 28 is arranged in the upstream side of the conveying direction of the print medium 19 (y direction illustrated in the figure) than the position of the print head 14. The main conveying roller 27 is arranged in the downstream side of a z direction in the figure, and the main pinch roller 28 is arranged in the upstream side of the z direction. An encoder unit 25 is attached to the main conveying roller 27. The encoder unit 25 includes an encoder sensor 25*a* and a code wheel 25*b*, and a rotating phase of the main conveying roller 27 is detected by reading a slit formed in the code wheel 25*b* by the encoder sensor 25*a*. An encoder reference sensor 26 detects a reference position of the encoder.

A pre-main roller pair included a pre-main conveying roller 21 and a pre-main pinch roller 22 is arranged in the upstream side of the y direction from the main roller pair. As illustrated in FIG. 4, the print head 14 is arranged in the order of print head 14*a* to print head 14*g* in the y direction. Each of sub conveying roller pairs that is including each of sub conveying rollers 29*a* to 29*g* and each of sub pinch rollers 30*a* to 30*g* is arranged in a position in the downstream side of the y direction to each of the print heads 14*a* to 14*g*. It should be noted that in the present specification, the sub conveying rollers 29*a* to 29*g* are collectively called "sub conveying roller 29", and the sub pinch rollers 30*a* to 30*g* are collectively called "sub pinch roller 30".

A print medium-leading end detecting sensor 23*a* is disposed between the pre-main pinch roller 22 and the main pinch roller 28, and a print medium-leading end detecting sensor 23*b* is disposed between the sub conveying roller 29*a* and the sub conveying roller 29*b*. Each of the print medium-leading end detecting sensors 23*a*, 23*b* detects the leading end of the print medium. The print medium-leading end detecting sensor 23*a* detects the leading end of the print medium 19 from the upstream side of the z direction, and the print medium-leading end detecting sensor 23*b* detects the leading end of the print medium 19 from the downstream side of the z direction.

An image-leading end detecting sensor 24 is disposed between the pre-main conveying roller 21 and the main conveying roller 27 to detect the leading end of an image. The image-leading end detecting sensor 24 detects the image printed on the print medium 19. More specifically at the time of printing one surface of the print medium 19, the image-leading end detecting sensor 24 detects the leading end of the image printed on the other surface. Although not illustrated, sensors are disposed in the surroundings of the printing unit 4 to detect temperature and humidity.

A loop shape of the print medium 19 is formed in each of the upstream side of the main conveying roller 27 and the downstream side of the sub conveying roller 29*g*. As a result, the printing unit 4 and the roller pair other than the roller pair in the surroundings do not affect the conveyance of the print medium 19. In addition, pressure of the main pinch roller 28 applied on the main conveying roller 27 is larger than each of pressure of the pre-main pinch roller 22 applied on the pre-main conveying roller 21 and pressure of the sub pinch roller 30 applied on the sub conveying roller 29. Therefore the print medium 19 is conveyed by rotation of the main conveying roller 27.

Figure 5:
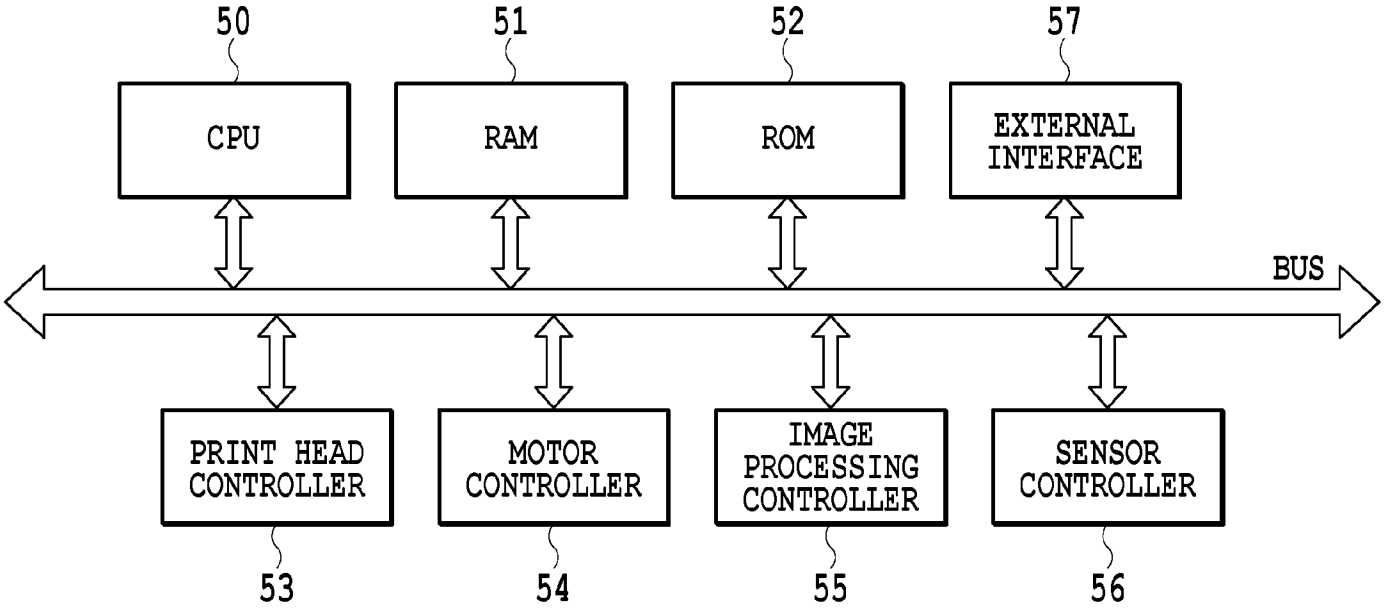
FIG. 5 is a block diagram illustrating the control configuration of the printing apparatus.

FIG. 5 is a block diagram illustrating the control configuration of the printing apparatus 20. The printing apparatus 20 is configured to connect an external interface 57, a CPU 50, a RAM 51, a ROM 52, a print head controller 53, a motor controller 54, an image processing controller 55 and a sensor controller 56 by a system bus.

The host apparatus 16 illustrated in FIG. 1 and the printing apparatus 20 are connected through the external interface 57. Input image data from the host apparatus 16 is input to the image processing controller 55 in the printing apparatus 20 through the external interface 57. The image processing controller 55 executes various kinds of processing to the input image data that is input from the host apparatus 16, thus converting the input image data into print data that can be printed in the printing apparatus 20. The CPU 50 controls operations of the printing apparatus 20. The ROM 50 stores various programs in advance, this various programs includes parameter information and the like. The RAM 51 is used as a work area at the execution of the various programs, and the like. The print head controller 53 controls an operation of the print head 14. The motor controller 54 controls operations of a plurality of motors (not illustrated) including motors used for rotating the rollers. The sensor controller 56 controls sensors arranged in the printing apparatus 20.

Figure 6:
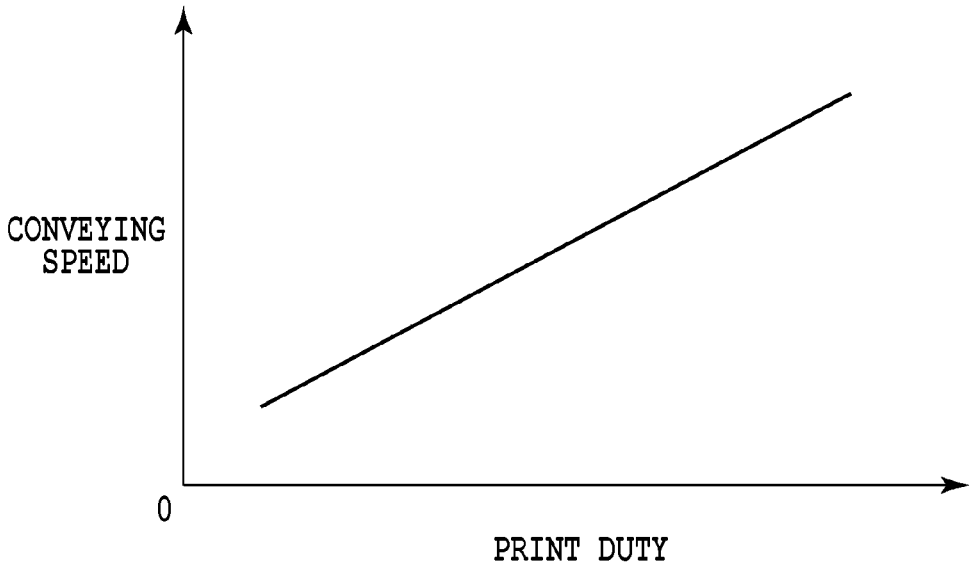
FIG. 6 is a graph illustrating a relationship between a print duty and a conveying speed of the printing medium.

FIG. 6 is a graph illustrating a relationship between a print duty of an image printed on one surface (front surface) of the print medium 19 and a conveying speed of the printing medium 19 at the time of printing an image on the other surface (back surface) of the print medium 19 (herein, referred to as "conveying speed at the back surface printing"). Herein, an explanation will be made of the case where an image is printed on the back surface after an image is printed on the front surface. In the graph illustrated in FIG. 6, a horizontal axis indicates a print duty of an image printed on the front surface (hereinafter, referred to as "front surface image") and a vertical axis indicates a conveying speed of the printing medium 19 at the time of printing an image on the back surface after the printing of the front surface. It should be noted that "print duty" means a ratio of an actually printed pixel number to a pixel number in print region. In the case where the print duty is relatively high, the application amount of ink on that print region becomes relatively large, and in the case where the print duty is relatively low, the application amount of ink on that print region becomes relatively small.

As illustrated in FIG. 6, the print duty of the front surface image and the conveying speed at the back surface printing have a nearly proportional relation. Specifically as illustrated in the graph of FIG. 6, there is a tendency that as the print duty of the front surface image is higher, the conveying speed of the print medium at the back surface printing is the faster.

In the case where the print duty is relatively high, a relatively large amount of ink is applied on the print medium, and this ink permeates the print medium to weaken the bonding between fibers of the print medium and soften the print medium. Therefore there is a tendency that a friction coefficient between the print medium and the conveying roller becomes high. When the friction coefficient between the print medium and the conveying roller becomes high, there is a tendency that a slip between the print medium and the conveying roller is hard to be generated and the conveying speed of the print medium at the back surface printing is faster than the conveying speed of the print medium 19 at the front surface printing. In the case where the conveying speed becomes fast, when ink is ejected from the nozzle for printing without changing the timing of ejecting the ink, an application position of an ink droplet on the print medium is a position shifted in the upstream side of the conveying direction from a desired position at the back surface printing.

In the case where the friction coefficient between the print medium and the conveying roller at the back surface printing is lower than the friction coefficient therebetween at the front surface printing, there is a tendency that a slip is easy to be generated between the print medium and the conveying roller and the conveying speed of the print medium at the back surface printing is slower than the conveying speed of the print medium at the front surface printing. In the case where the conveying speed becomes slow, when ink is ejected from the nozzle for printing without changing the timing of ejecting the ink, an application position of an ink droplet on the print medium is a position shifted in the downstream side of the conveying direction from a desired position at the back surface printing.

In this manner, the friction coefficient between the print medium and the conveying roller changes between the front surface printing and the back surface printing according to the print state of the front surface of the print medium, and the conveying speed of the print medium changes between the front surface printing and the back surface printing. Therefore there are some cases where the application position of the ink droplet on the print medium, that is, the print position of the ink is shifted from the desired position to degrade image quality of the back surface. For prevention of this degradation of image quality, in the present embodiment, print timing (ejection timing of ink) of an image at the back surface printing is corrected according to the print state of the front surface making contact with the conveying roller at the back surface printing. Specifically a print clock correction value for correction of the ejection timing is calculated using the print duty of the front surface image as one parameter, and this print clock correction value is used to generate a print clock. Ink is ejected from the print head in response to the corrected print clock to suppress the print position shift at the back surface printing.

Figure 7:
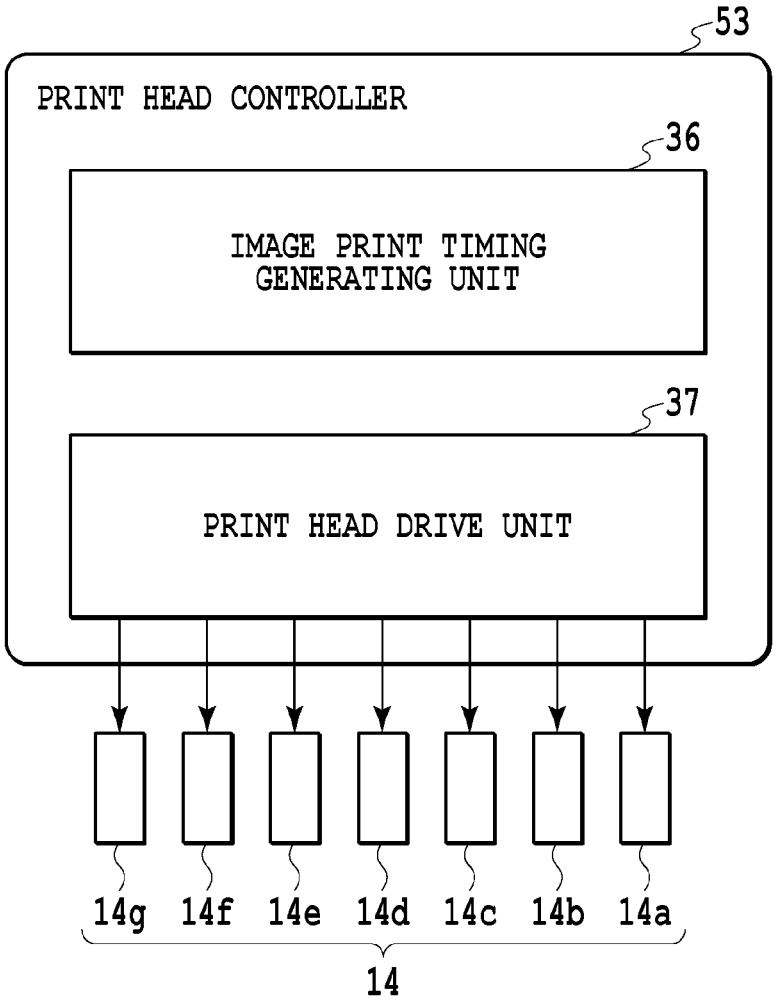
FIG. 7 is a block diagram illustrating the configuration of a print head controller.

FIG. 7 is a block diagram illustrating the configuration of the print head controller 53 illustrated in FIG. 5. As illustrated in FIG. 7, the print head controller 53 includes the image print timing generating unit 36 and the print head drive unit 37.

The image print timing generating unit 36 generates various signals in regard to the print timing for controlling the print timing (ejection timing of ink) of an image by the print head 14. A print position shift generated in the case where the conveying speed of the print medium 19 varies or print density unevenness due to the variation is corrected by the generated signal, and the ejection timing of ink is controlled to cancel out the speed variation based upon a predetermined average conveying speed. Although described later by referring to FIG. 8, the image print timing generating unit 36 is connected to the encoder sensor 25*a*, the encoder reference sensor 26 and the image-leading end detecting sensor 24, and is configured to receive signals from these sensors. In addition, nozzle associated data such as a position relation and a distance between the nozzles in the print head 14 is input to the image print timing generating unit 36. The image print timing generating unit 36 generates print clocks based upon the nozzle associated data, signals from the encoder sensor 25*a* and the like, which will be output to the print head drive unit 37. The details thereof will be described later by referring to FIG. 11. The print head drive unit 37 outputs the input print clock and print data to the print head 14.

Figure 8:
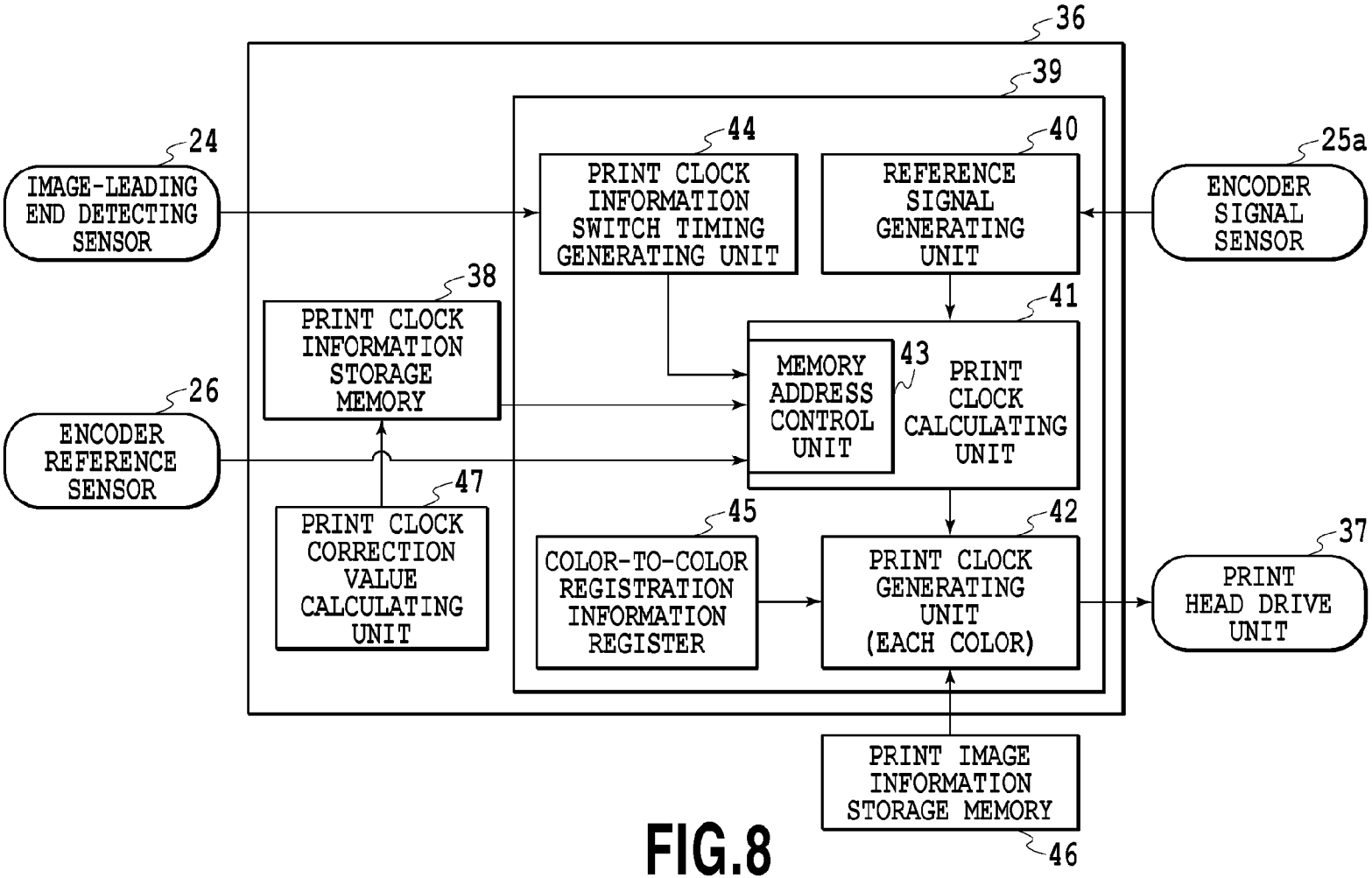
FIG. 8 is a block diagram illustrating the configuration of an image print timing generating unit.

FIG. 8 is a block diagram illustrating the configuration of the image print timing generating unit 36 illustrated in FIG. 7. As illustrated in FIG. 8, the image print timing generating unit 36 includes a print clock information storing memory 38, a timing generating unit 39, and a print clock correction value calculating unit 47.

In the present embodiment, the print clock correction value calculating unit 47 divides the front surface image in the conveying direction and calculates a print duty for each of the divided areas (unit region). The method for calculating the print duty is not limited particularly, and the known method may be used. The print clock correction value calculating unit 47 refers to tables which showing in FIG. 9 and FIGS. 10A and 10B, and thereby finds a print clock correction value corresponding to the calculated print duty, which will be stored in the print clock information storing memory 38.

The print clock information storing memory 38 is a memory for storing the print clock correction value (print clock information). The print clock correction value is calculated using information in regard to a change in conveying speed, such as the kind of the print medium, a roller diameter of each roller, eccentricity of each roller and a print duty of a front surface image as parameters. In the present embodiment, the information in regard to a change in conveying speed (information in regard to an error of a conveyance length), such as a roller diameter of each roller and eccentricity of each roller is in advance set to the apparatus. Such information in regard to a change in conveying speed is stored as conveying-speed changing information in a table to be described later by referring to FIG. 9. Further, an output side of the print clock information storing memory 38 is connected to the timing generating unit 39.

The timing generating unit 39 includes a reference signal generating unit 40, a print clock calculating unit 41, a print clock generating unit (each color) 42, a print clock information switch timing generating unit 44 and a color-to-color registration information register 45. The reference signal generating unit 40 is connected to the encoder sensor 25*a*, and is configured to receive input of an encoder signal from the encoder sensor 25*a*, and generates a reference signal based thereupon. The generated reference signal is output to the print clock calculating unit 41.

The print clock calculating unit 41 has an input side that is connected to the reference signal generating unit 40, the print clock information switch timing generating unit 44 and the print clock information storing memory 38 to generate print clocks. The generated print clock is output to the print clock generating unit (each color) 42. The print clock calculating unit 41 includes a memory address control unit 43. The memory address control unit 43 has an input side that is connected to the encoder reference sensor 26, and is configured to receive input of a sensor signal indicating a reference position of the encoder. The memory address control unit 43 has a memory address counter to be cleared by a signal of the encoder reference sensor 26, and controls access to the print clock information storing memory 38.

The print clock generating unit (each color) 42 has an input side that is connected to the print clock calculating unit 41, the color-to-color registration information register 45 and the print image information storing memory 46, and generates a print clock corresponding to each color. Information in regard to color-to-color registration adjustment is stored in the color-to-color registration information register 45. Information in regard to an image to be printed is stored in the print image information storing memory 46. The print clock of each color generated by the print clock generating unit (each color) 42 is output to the print head drive unit 37.

An image-leading end detecting signal from the image-leading end detecting sensor 24 is input to the print clock information switch timing generating unit 44. The print clock switch timing generating unit 44 generates a print clock information switch timing signal based thereupon. A signal for switching the reference destination of the print clock information storing memory 38 is generated at timing of a boundary between the divided areas of the print medium 19 in the conveying direction (at timing of switching from some unit region to the next unit region), with a signal from the image-leading end detecting sensor 24 as a starting point. That is, the signal for switching the reference destination of the print clock information storing memory 38 is generated for each unit region of the back surface corresponding to the unit region of the front surface in which the print duty is calculated. The reference destination of the print clock information storing memory 38 is switched at the timing of this switch timing signal, and the print clock calculating unit 41 generates a print clock according to the referenced information.

FIG. 9 is a diagram illustrating an example of a table in which a print duty of a front surface image is associated with conveying speed changing information. The table illustrated in FIG. 9 is a calculation table used for calculating a print clock correction value, and is in advance stored in a predetermined memory. The print clock correction value calculating unit 47 uses the calculation table illustrated in FIG. 9 to calculate a print clock correction value. The print clock correction value is calculated based upon the conveying speed changing information corresponding to the print duty.

FIGS. 10A and 10B are tables illustrating the details of print clock information that is stored in the print clock information storing memory 38 illustrated in FIG. 8. As illustrated in FIG. 10A, print clock correction values calculated at the print clock correction value calculating unit 47 are stored in the print clock information storing memory 38. In addition, as illustrated in FIG. 10B, the print clock correction value includes a column number, a latch interval, a delay time and the like. The column number represents a column number per one split. The latch interval represents an interval between the print clocks, and represents an interval that outputs a time-division drive signal. The delay time represents a time for delaying timing of generating a reference signal. The details will be described later by referring to FIG. 12.

Figure 11:
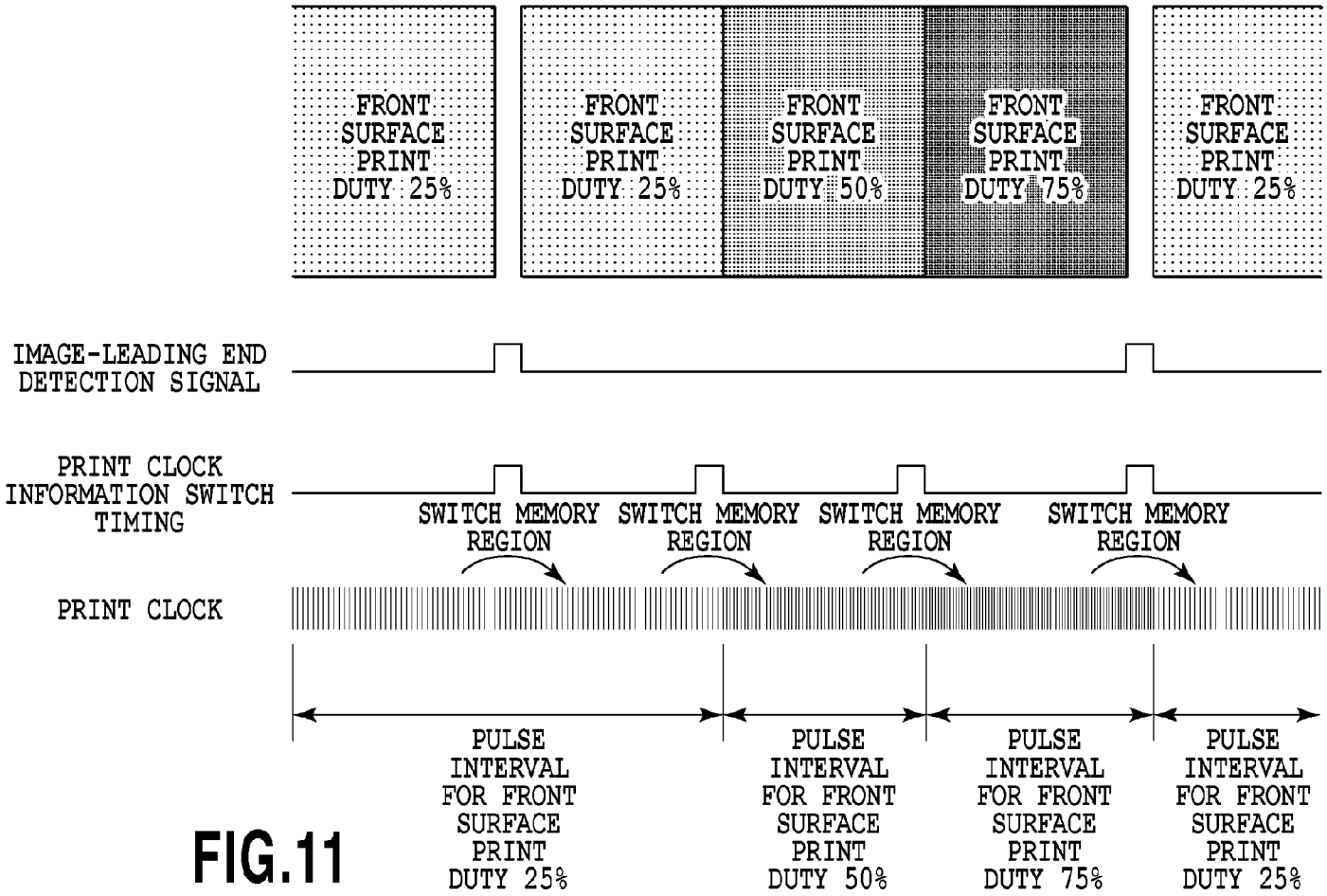
FIG. 11 is a diagram for explaining generation of print clocks.

FIG. 11 is a diagram for explaining the details until a point of generating a print clock according to a print duty of a front surface image. As illustrated in FIG. 11, the image-leading end detecting sensor 24 outputs an image-leading end detecting signal upon detecting the leading end of an image. A print clock information switch timing signal generated using the image-leading end detecting signal as the starting point is output from the print clock information switch timing generating unit 44. The print clock calculating unit 41 switches the reference destination (address illustrated in FIG. 10A) of the print clock information storing memory 38 at the timing by this print clock information switch timing signal to generate a print clock according to the content of the reference destination. That is, the print clock calculating unit 41 generates the corrected print clock by using the print clock correction value of the reference destination.

As illustrated in FIG. 11, an interval between print clocks on the back surface corresponding to a unit region having 25% of the print duty in the front surface image is wider than an interval between print clocks on the back surface corresponding to a unit region having 50% of the print duty in the front surface image. In addition, an interval between print clocks on the back surface corresponding to a unit region having 75% of the print duty in the front surface image is narrower than an interval between print clocks on the back surface corresponding to a unit region having 50% of the print duty in the front surface image. In this way, in the present embodiment, the interval between the print clocks is appropriately adjusted according to the print duty of the front surface image as a factor that causes the change in conveying speed of the print medium, thus controlling the ejection timing of ink.

As described above, in the case where the print duty is relatively high and the conveying speed of the print medium becomes fast, the ink is applied in the position in the upstream side of the conveying direction of the print medium from the desired position. In this case, for applying the ink to the desired position, the interval between the print clocks (latch interval) is made relatively short to quicken the ejection timing of ink. That is, a drive cycle of the print element at the back surface printing is made shorter than a drive cycle of the print element at the front surface printing to quicken the ejection timing of ink. On the other hand, in the case where the conveying speed of the print medium becomes slow as described above, the ink is applied in the position in the downstream side of the conveying direction of the print medium from the desired position. In this case, for applying the ink to the desired position, the latch interval is made relatively long to delay the ejection timing of ink. That is, the drive cycle of the print element at the back surface printing is made longer than the drive cycle of the print element at the front surface printing to delay the ejection timing of ink.

Figure 12:
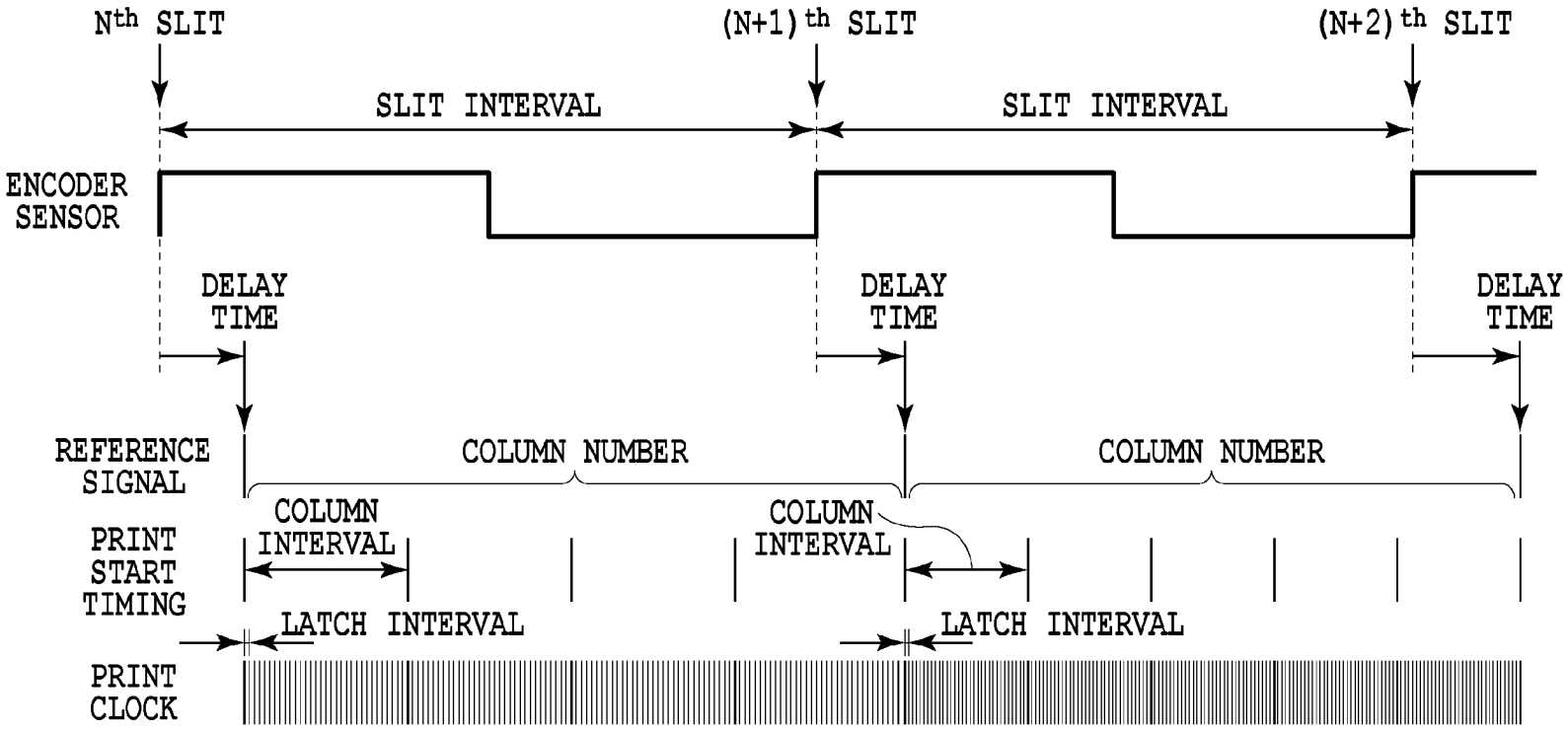
FIG. 12 is a diagram illustrating a timing chart of signals.

FIG. 12 is a diagram illustrating a timing chart of a signal relating to generation of a drive signal at the timing generating unit 39. It should be noted that FIG. 12 is an explanatory diagram when a signal of $N^{th}$ slit, a signal of $(N+1)^{th}$ slit and a signal of $(N+2)^{th}$ slit of encoder signals of the encoder sensor 25*a* are input.

The reference signal generating unit 40 generates a reference signal at timing delayed by a delay time of a print clock correction value from a rising edge of a signal from the encoder sensor 25*a*. This is because in the case of setting the column number having the number to the extent that the columns cannot fall between the encoder edges, a signal of the final column is completely output by delaying a starting position of the next edge.

The print clock calculating unit 41 generates print clocks between reference signals corresponding to the column number of the print clock correction value. The print clock generating unit (each color) 42 generates a print clock of each color based upon the print clock generated at the print clock calculating unit 41 and the information from the color-to-color registration information register 45, and outputs the generated print clock to the print head drive unit 37. The print head drive unit 37 outputs the print clock generated at the timing generating unit 39 and the print data processed in the image processing controller illustrated in FIG. 5 to each print head 14. Each print head 14 ejects the ink based upon the print data at timing by the print clock to print an image. In the present embodiment, the print head 14 is driven in a time-division manner. Here, the column number is in advance set, but the latch interval is adjusted as needed according to the print duty as described later, and the column interval changes according to the latch interval. Therefore the delay time is adjusted as needed in response thereto.

As described above, in the present embodiment, the print clock at the back surface printing is generated using the print clock correction value calculated based upon the print duty of the front surface image, and the ink is ejected in response to the generated print clock at the back surface printing. Thereby, even in the case where the friction coefficient between the print medium and the conveying roller changes between the front surface printing and the back surface printing to change the conveying speed of the print medium between the front surface printing and the back surface printing, it is possible to suppress the print position shift at the back surface printing. In the case of ejecting inks of different colors from the respective print heads as in the case of the present embodiment by suppressing the print position shift, a print position shift between the colors can be suppressed to suppress quality degradation of a color image. Even in the case of ejecting inks of the same color from the respective print heads, density unevenness due to the shifting of the print position can be suppressed. In addition, in the case of printing images each of which is identical in horizontal and vertical sizes on the front surface and on the back surface, an error in dimension between the front and back images can also be suppressed.

(Second Embodiment)

Figure 13A:
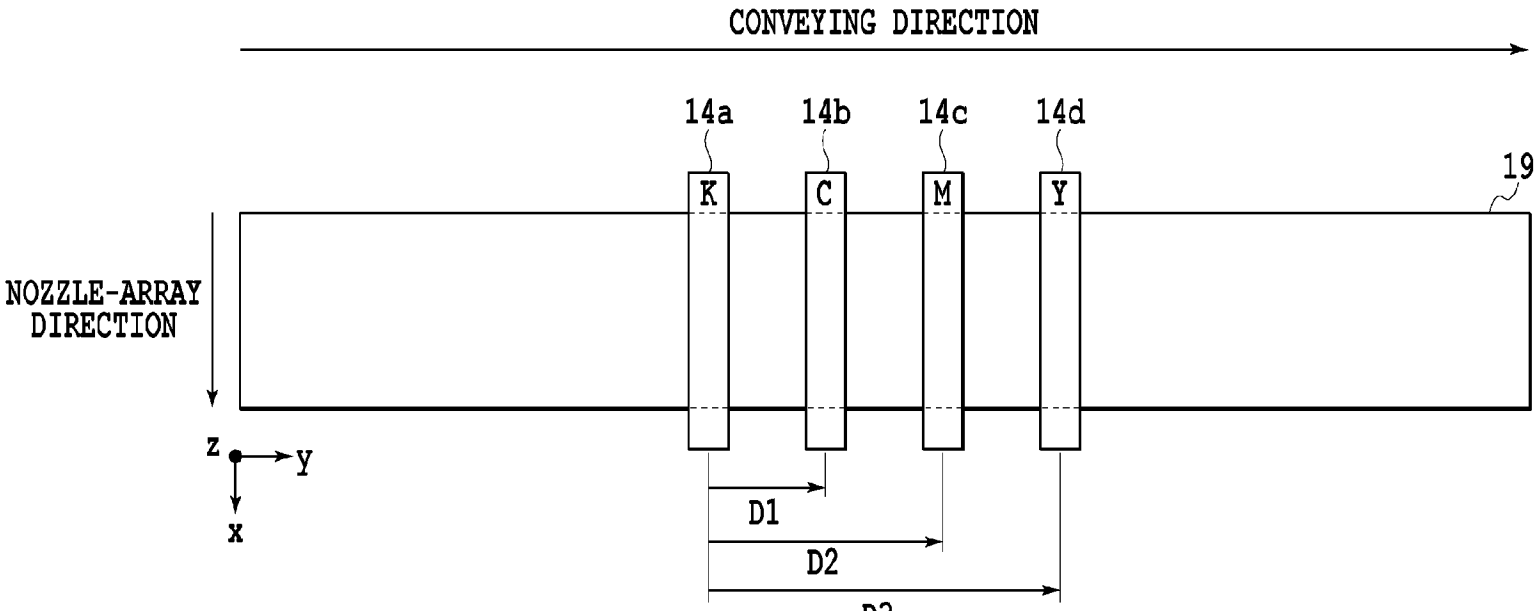
FIG. 13A is a schematic diagram illustrating the relative-movement relationship between print heads and a print medium.

The present embodiment uses four print heads. FIG. 13A is a schematic diagram for explaining the arrangement of print head 14 in the present embodiment, and a top view illustrating the print head 14 of the printing unit 4 in FIG. 1. As illustrated in FIG. 13A, the print heads 14*a* to 14*d* are arranged in the direction of conveying the print medium 19 in the order of the print head 14*a*, the print head 14*b*, the print head 14*c* and the print head 14*d* from an upstream side in the conveying direction. Ink is applied on the print medium 19 in the arrangement order of the print heads 14*a* to 14*d*. Here, a black ink (K) is ejected from the nozzle of the print head 14*a*, a cyan ink (C) is ejected from the nozzle of the print head 14*b*, a magenta ink (M) is ejected from the nozzle of the print head 14*c*, and a yellow ink (Y) is ejected from the nozzle of the print head 14*d*.

In the present embodiment, the four print heads 14*a* to 14*d* are provided for inks of four KCMY colors, but the number of ink colors and the number of print heads are not limited to four. In the present embodiment the length of each of the print heads 14*a* to 14*d* in the main scanning direction is 12 inches in width. However, the length of the print head in the main scanning direction, usable in the present invention, is not limited to this.

Distances D1 to D3 in FIG. 13A each represent the amount of a shift between print positions on the print medium 19 between the nozzle arrays of the respective print heads (distance between dots) when ink is ejected with the same timing. The print position shift between nozzle arrays is caused under the influence of, not only the interval between nozzle arrays in the print heads 14*a* to 14*d*, but also such as ejection angles of the print heads, ejection speeds, the distance between the print head and the print medium, and the like. Distances D1 to D3 each include the print position shift caused under the influence thereof, and at the time of actually performing a print on the print medium, the timing of ejecting the ink is controlled in consideration of the distances D1 to D3.

Figure 14:
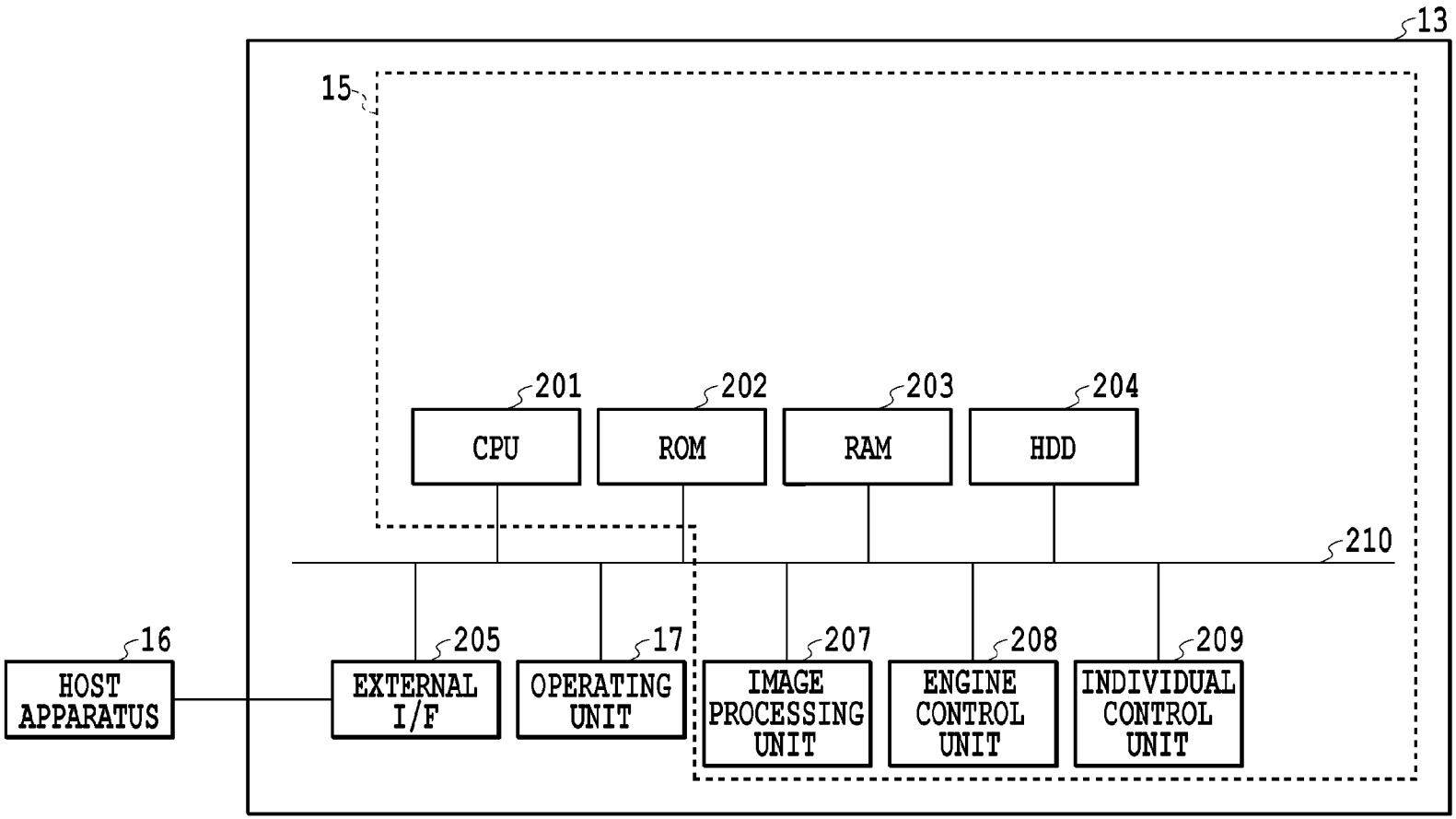
FIG. 14 is a block diagram illustrating the control system of the inkjet printing apparatus.

FIG. 14 is a block diagram illustrating the control system of the printing apparatus 20. As illustrated in FIG. 14, a control unit 13 is connected to the host apparatus 16 via an external interface 205. The control unit 13 includes the controller 15 and an operating unit 17 in addition to the external interface 205. The controller 15 controls the operation of the paper feeder 1, printing unit 4, inspection unit 5, cutting unit 6, conveying mechanism and the like through an engine control unit 208 and an individual control unit 209. In short, the controller 15 performs various kinds of control. As illustrated in FIG. 14, the controller 15 includes a CPU 201, ROM 202, RAM 203, HDD 204, image processing unit 207, engine control unit 208, and individual control unit 209.

For integrated control for operation of various components, the CPU 201 executes various programs. The ROM 202 stores various programs to be executed by the CPU 201 and fixed data desired for operation of various components in the printing apparatus 20. The RAM 203 is used as a work area for the CPU 201 and a temporary storage area to store various kinds of received data. The RAM 203 also stores various kinds of setting data. HDD 204 stores various kinds of programs, print data and various kinds of setting information desired for operation of various components of the printing apparatus 20.

The image processing unit 207 performs image processing on image data received from the host apparatus 16 to generate print data to be printed by use of the print heads 4*a* to 4*d*. Specifically, the image processing unit 207 performs color conversion processing and quantization processing on the received image data. Also the image processing unit 207 performs resolution conversion, image analysis, image correction and the like as necessary. The print data obtained through the steps of the image processing is stored in the RAM 203 or the HDD 204.

The engine control unit 208 controls, based on control commands received from the CPU 201 and the like, driving of the print heads 14*a* to 14*d* of the printing unit 4 according to the print data. The engine control unit 208 also controls an operation of the conveying mechanism and the like. The individual control unit 209 is a sub-controller to drive the paper feeder 1, the inspection unit 5, the cutting unit 6, the drying unit 8 and the discharging unit, based on control commands received from the CPU 201.

The operating unit 17 is an input/output interface to the user, which includes an input unit and an output unit. The input unit includes hard keys, a touch panel and the like to receive instructions from the user. The output unit includes a display, a speech generation device and the like to display or utter information for conveyance of information to the user. The external interface 205 is provided for connection of the controller 15 to the host apparatus 16. The above configuration components are connected through a system bus 210.

The host apparatus 16 is a supply source of image data. The printing apparatus 20 prints an image to the print medium 19 to obtain an output product on the basis of the image data supplied from the host apparatus 16. The host apparatus 16 may be either a general-purpose apparatus such as a computer, or a dedicated image apparatus such as an image capture apparatus having an image reader, a digital camera or a photo storage device. In the case of the host apparatus 16 being a computer, an operating system, application software and a printer driver for the printing apparatus 1 should be installed in the storage device of the computer. It should be noted that not all of the processes described above need be performed by software, and that one or all of the processes may be provided by hardware.

Figure 15:
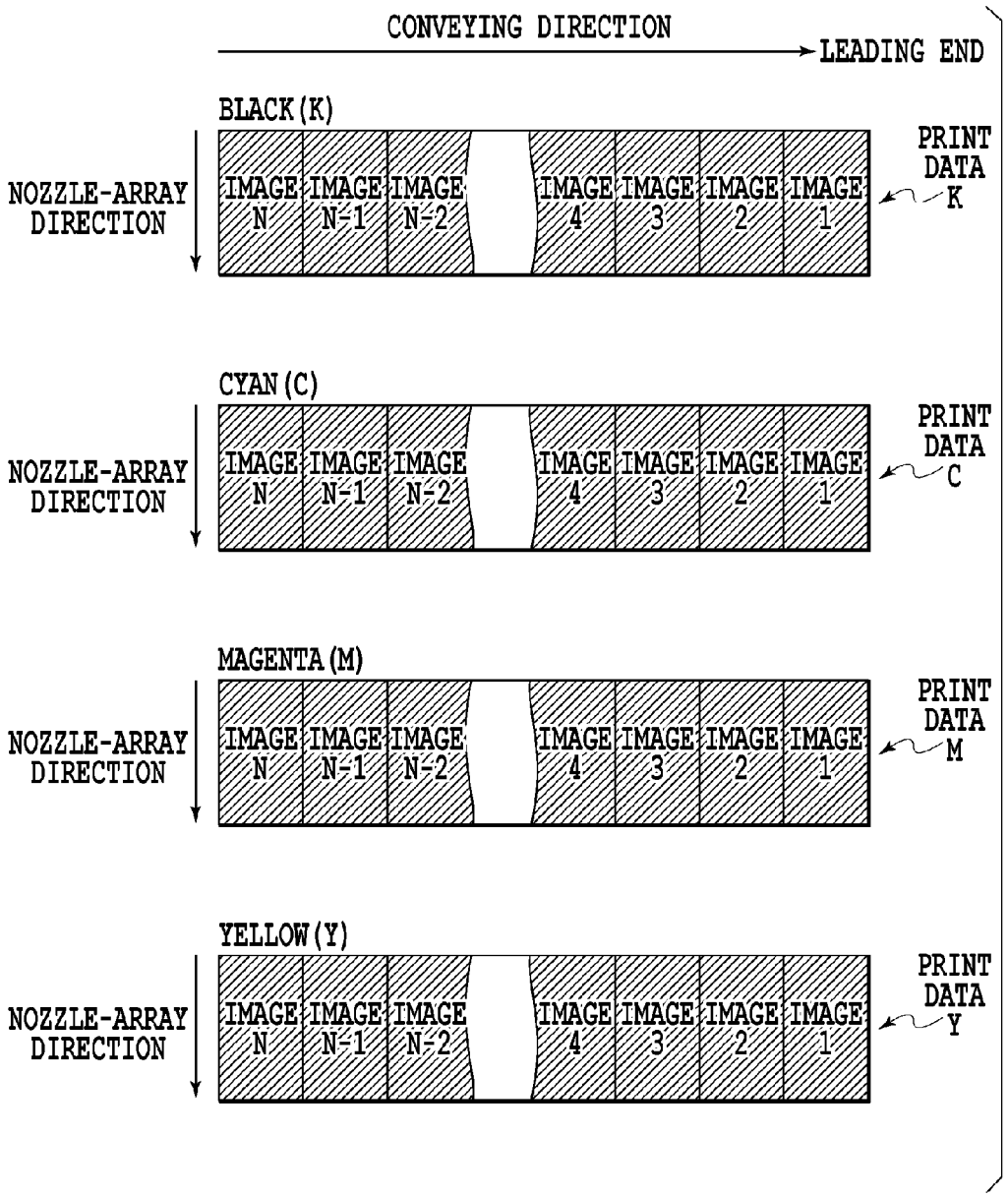
FIG. 15 is a schematic diagram illustrating an array of images to be printed by each of the print heads.

FIG. 15 is a schematic diagram illustrating an array of images to be printed by each of the print heads 14*a* to 14*d*, in which sets of print data K, C, M, Y are formed respectively of print data to be printed by the print heads 14*a* to 14*d*. The print data is obtained by performing predetermined image processing on the image data for quantization, in which printing (1) or non-printing (0) of a dot on each individual pixel is defined.

As illustrated in FIG. 15, in all the print heads, an image is printed in the order of image 1 to image N shown in FIG. 15, and the image is printed by the print heads 14*a*, 14*b*, 14*c* and 14*d* in this order as described in FIG. 13A. That is, the printing of an image 1 is first performed by the print head 14*a*, and then, in order, by the print head 14*b*, the print head 14*c* and the print head 14*d*, and thus, the printing of the image 1 is completed.

The CPU 201 reads print data stored in the RAM 203 or HDD 204 after having undergone processing at the image processing unit 207, and then sends the read print data to the engine control unit 208. The engine control unit 208 controls the print heads 14*a* to 14*d* to print images according to the sets of print data corresponding to the print heads 14*a* to 14*d*.

<Case which Null Data are Added to Print Data in Advance>

Figure 16:
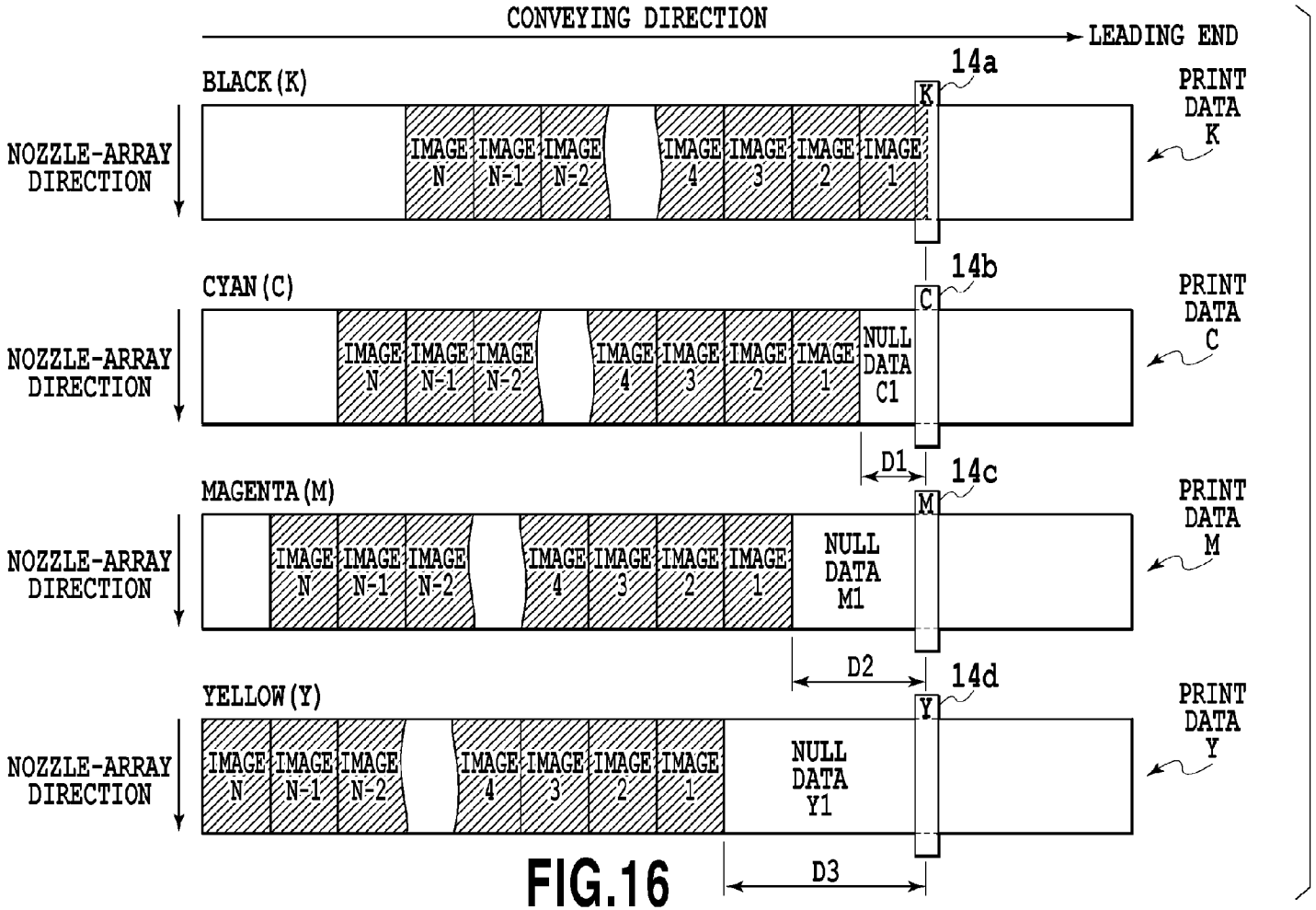
FIG. 16 is a schematic diagram illustrating print data for the individual print heads to which null data is preliminarily added.

FIG. 16 is a schematic diagram illustrating print data for the print heads 14*a* to 14*d*, for which null data have been added. As illustrated in FIG. 16, null data C1 to Y1, for each of which the number of lines corresponds to the distances D1 to D3, explained while referring to FIG. 13A, are added to positions antecedent to the images 1 to be printed by the print heads 14*b* to 14*d*. Here, a line is a region on which printing is performed in one ejection operation by a nozzle array, which is a region of a 1-pixel width along the width direction of the print medium 19 (x direction). The CPU 201 adds null data to the print data.

Figure 17:
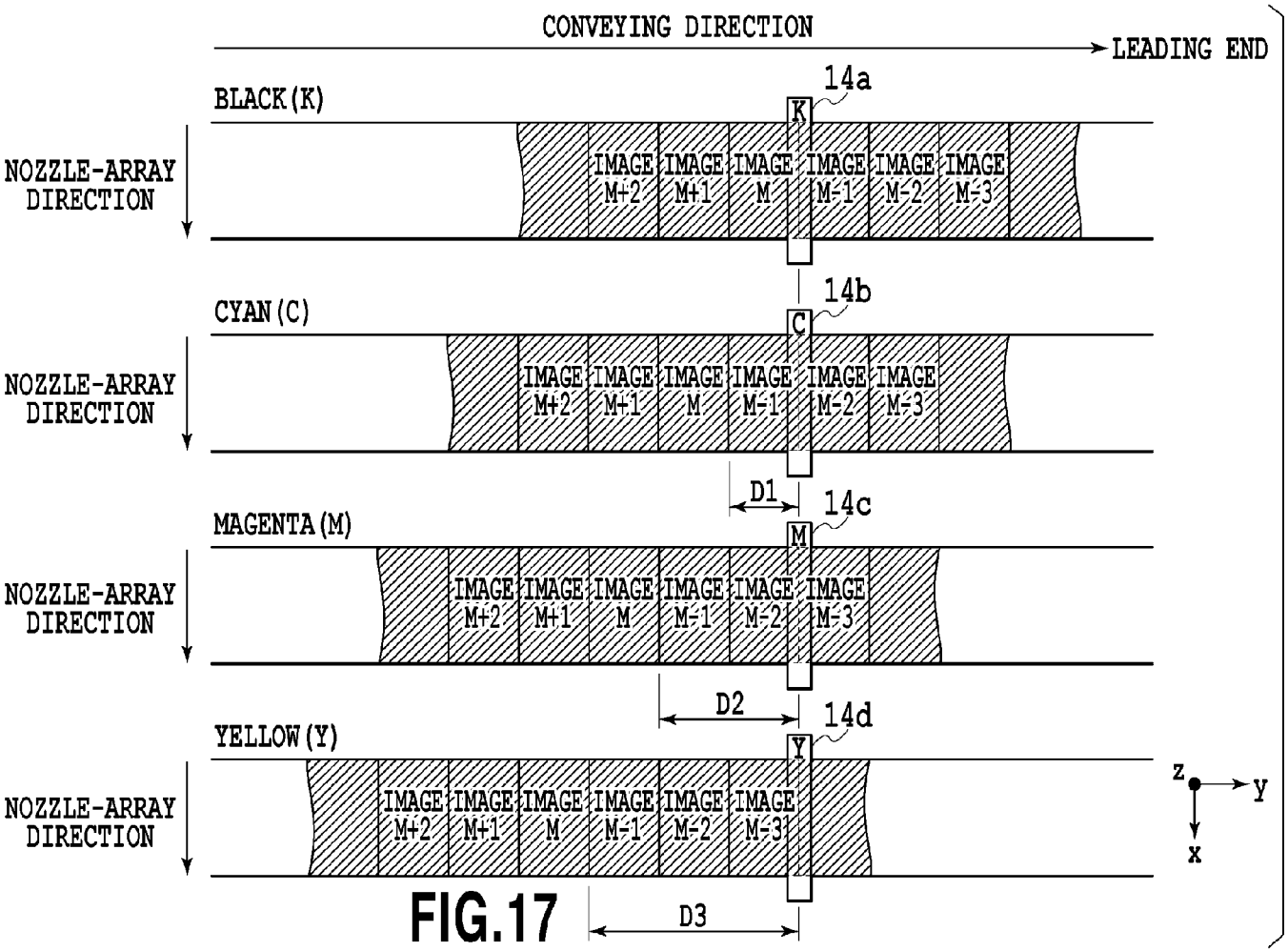
FIG. 17 is a schematic diagram illustrating print timing in the state illustrated in FIG. 16.

FIG. 17 is a schematic diagram illustrating print timing for the print data illustrated in FIG. 16. Specifically, FIG. 17 is a diagram schematically illustrating timing for printing image M, in which the amount of conveyance of the print medium 19 is a desired amount of conveyance.

As described in FIG. 16, the null data C1 having the number of lines corresponding to the distance D1 is added to the print data C for the print head 14*b* to precede the image 1. Accordingly, the print position shift between the print heads 14*a* and 14*b* is able to be adjusted by the null data C1. As a result, as illustrated in FIG. 17, the printing of the image M can be started at a position at the distance D1 from the print starting position of an image M−1, which precedes the image M. Likewise, as described in FIG. 16, the null data M1 having the number of lines corresponding to the distance D2 is added to the print data M for the print head 14*c* to precede the image 1. Accordingly, as illustrated in FIG. 17, the print position shift between the print heads 14*a* and 14*c* can be adjusted by the null data M1. Regarding the print head 14*d*, as described in FIG. 16, the null data Y1 having the number of lines corresponding to the distance D3 is added to the print data Y to precede the image 1. Accordingly, the print position shift between the print heads 14*a* and 14*d* can be adjusted by the null data Y1 as illustrated in FIG. 17. In this manner, when the amount of conveyance of the print medium 19 is equal to a desired amount of conveyance, the null data C1, M1, Y1 having respectively the numbers of lines corresponding to the distances D1, D2, D3 are added to the print data C, M, Y in advance, thus achieving the alignment of the print starting positions of the nozzle arrays of the respective print heads 14*a* to 14*d*.

As described above, when the amount of conveyance of the print medium 19 does not vary, by adding predetermined null data to print data beforehand, adjustment of timing for ejecting ink between nozzle arrays is achieved, so that the print positions on the print medium are aligned with each other between nozzle arrays.

However, there are some cases where the amount of conveyance of the print medium changes with a change in friction coefficient between rollers in the conveying mechanism (hereinafter, referred to as "conveying roller") and the print medium due to a state change of a front surface by attachment of paper powder onto the front surface of the conveying roller, the water content of the print medium, the surrounding condition in the printing apparatus and the like. In addition, there are some cases where the conveying speed of the print medium changes by a change of a rotating speed or rotating number of a motor for driving the conveying roller or the like to change the amount of conveyance of the print medium. Accordingly even in the case where the null data is in advance added to the head of the print medium, when the amount of conveyance of the print medium 19 changes, the print position on the print medium 19 is shifted between nozzle arrays.

For that reason, here, an inspection pattern is printed on a non-image region of the print medium 19, and the inspection unit 5 reads the printed inspection pattern. The inspection unit 5 sends the read information to the controller 15. The CPU 201 in the controller 15 finds a print position shift between nozzle arrays from the information (read result) obtained from the inspection unit 5, and adds adjustment data (non-image data/null data) of the line number (pixel number) corresponding to this shift between images of the respective print heads as adjustment patterns. That is, the line number of the adjustment data to be added is appropriately adjusted according to the shift amount of the print position. Therefore even in the case where the amount of conveyance of the print medium 19 changes in the middle of printing the image on the print medium 19, the shift of the print position is corrected.

Next an explanation will be made of a specific correction method.

<Case which the Amount of Conveyance is Shorter than a Desired Amount of Conveyance>

First, the case where the amount of conveyance of the print medium 19 is shorter than a desired amount of conveyance will be described. FIGS. 18A to 18D are schematic diagrams showing print timing when the amount of conveyance of the print medium 19 is short as compared with the case in FIG. 17.

When the amount of conveyance is equal to the desired amount of conveyance, at the timing when the print head 14*a* starts printing the head of an image M, the print head 14*b* starts printing an image M−1 (see FIG. 17). However, when the amount of conveyance of the print medium 19 is shorter than the desired amount of conveyance, at the timing when the print head 14*a* starts printing the head of an image M, the head of the image M−1 which has been printed by the print head 14*a* is located upstream of the position of the print head 14*b*.

Figures 18A, 18B, 18C, 18D:
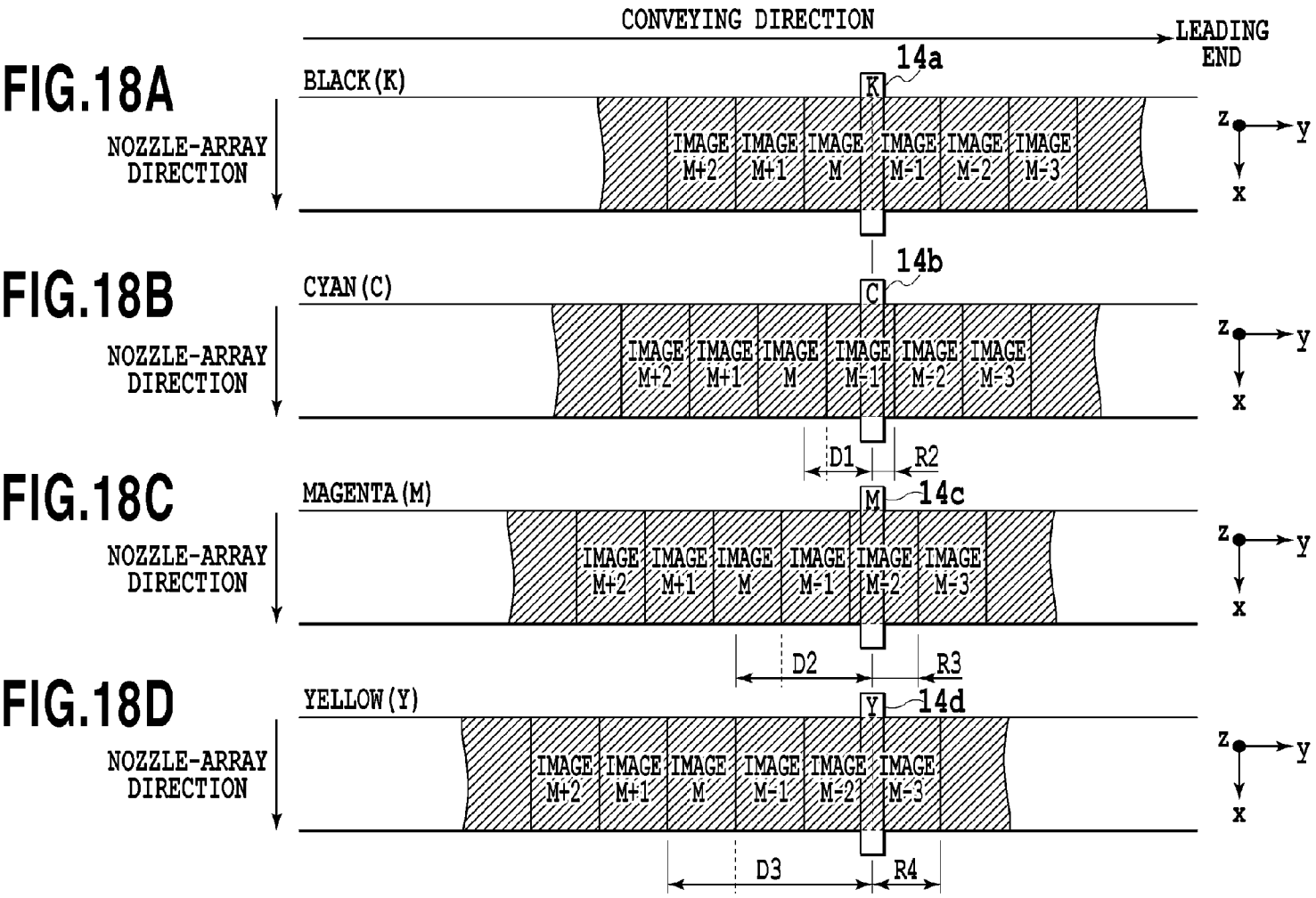
FIG. 18A is a schematic diagram illustrating printing when the amount of conveyance is shorter as compared with FIG. 17.
FIG. 18B is a schematic diagram illustrating printing when the amount of conveyance is shorter as compared with FIG. 17.
FIG. 18C is a schematic diagram illustrating printing when the amount of conveyance is shorter as compared with FIG. 17.
FIG. 18D is a schematic diagram illustrating printing when the amount of conveyance is shorter as compared with FIG. 17.

At the timing when the head of the image M−1 printed by the print head 14*a* is located actually in the print position of the print head 14*b*, as illustrated in FIG. 18B, the print head 14*b* has already printed R2 lines of the image M−1. Likewise, at the timing when the head of the image M−2 printed by the print head 14*a* is located actually in the print position of the print head 14*c*, as illustrated in FIG. 18C, the print head 14*c* has already printed R3 lines of an image M−2. Further, at the timing when the head of an image M−3 printed by the print head 14*a* is located actually in the print position of the print head 14*d*, as illustrated in FIG. 18D, the print head 14*d* has already printed R4 lines of the image M−3.

As illustrated in FIGS. 18A to 18D, when the amount of conveyance of the print medium 19 is shorter than the desired amount of conveyance, in the print heads 14*b* to 14*d*, the image M is printed from a position preceding a desired print starting position. Therefore, in the printing of the image M by the print head 14*b*, the print head 14*b* prints the image M on a portion of the image M−1 which has been printed by the print head 14*a* before printing the image M. Such a print position shift is similarly produced in the print head 14*c*. In the print head 14*d*, the image M is printed on the image M−1 which has been printed by the print head 14*a*.

In the present embodiment, even if such a print position shift has occurred, the adjustment data (null data) is added as an adjustment pattern to the print data in order to adjust the print position for correction for the print position shift. Specifically, as described above, the inspection unit 5 reads the inspection pattern printed by the printing unit 4 in order to measure the amount of the print position shift. For correction for the print position shift, adjustment data are added respectively to the print data for the print heads. Then, when the amount of conveyance is shorter than a predetermined amount as described in the present embodiment, as a print head is located in the more downstream side, the number of lines for the adjustment data (null data) added before the image M is made the larger. As a result, the timing for printing the image M is retarded. Thus, the print starting positions of all the print heads are adjusted.

Figure 19:
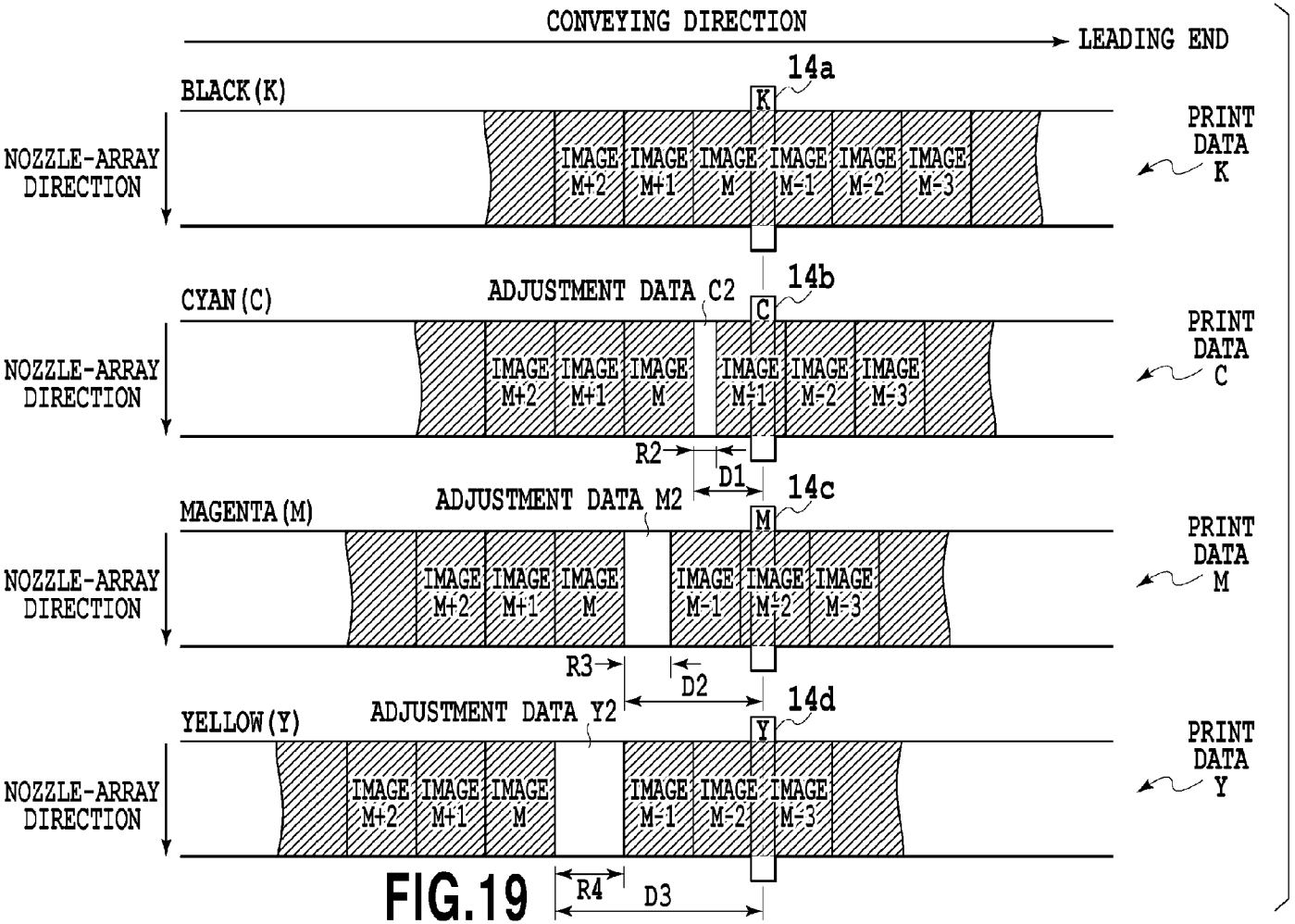
FIG. 19 is a schematic diagram illustrating the printing after correction for the states illustrated in FIGS. 18A to 18D.

This method will be described with reference to FIG. 19. FIG. 19 is a schematic diagram illustrating the state of bringing print positions of the image M into proper alignment with each other by use of the four print heads after the correction for the state illustrated in FIGS. 18A to 18D. When the CPU 201 determines that the amount of conveyance of the print medium 19 is shorter than a desired amount of the conveyance, the adjustment data C2, M2, Y2 are added respectively to the print data C, M, Y for the print heads 14*b*, 14*c*, 14*d* in which the print position shift has occurred.

Between the image M−1 and the image M, adjustment data C2 corresponding to R2 lines is added for the print head 14*b*, adjustment data M2 corresponding to R3 lines is added for the print head 14*c*, and the adjustment data Y2 corresponding to R4 lines is added for the print head 14*d*. The number of lines R3 of the adjustment data M2 is set to be greater than the number of lines R2 of the adjustment data C2, while the number of lines R4 of the adjustment data Y2 is further greater than the number of lines R3 of the adjustment data M2.

In this manner, adding the adjustment data C2, M2, Y2 allows the print starting positions of the respective print heads for the image M to be aligned on the print medium, thus correcting the print position shift.

<A Case which the Amount of Conveyance is Longer than a Desired Amount of Conveyance>

Next, the case where the amount of conveyance of the print medium 19 is longer than a desired amount of conveyance will be described. FIGS. 20A to 20D are schematic diagrams illustrating print timing when the amount of conveyance of the print medium 19 is longer as compared with the case in FIG. 17.

When the amount of conveyance is equal to a desired amount of conveyance, at the timing when the print head 14*a* starts printing the head of an image M+1, the print head 14*b* starts printing an image M (see FIG. 17). However, when the amount of conveyance of the print medium 19 is longer than the desired amount of conveyance, at the timing when the print head 14*a* starts printing the head of the image M+1, the head of the image M which had been printed by the print head 14*a* has been already located downstream of the position of the print head 14*b*.

Figures 20A, 20B, 20C, 20D:
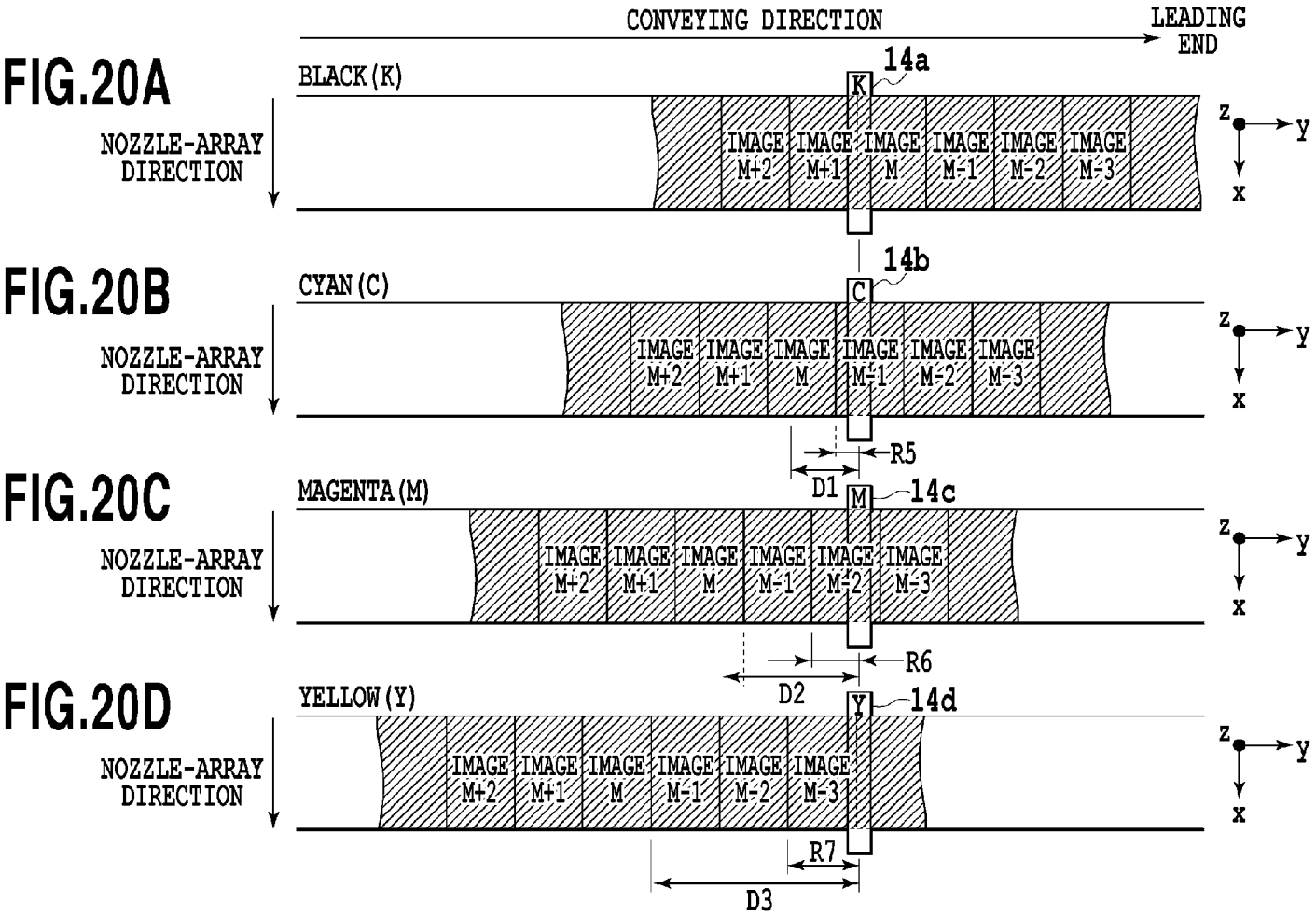
FIG. 20A is a schematic diagram illustrating printing when the amount of conveyance is longer as compared with FIG. 17.
FIG. 20B is a schematic diagram illustrating printing when the amount of conveyance is longer as compared with FIG. 17.
FIG. 20C is a schematic diagram illustrating printing when the amount of conveyance is longer as compared with FIG. 17.
FIG. 20D is a schematic diagram illustrating printing when the amount of conveyance is longer as compared with FIG. 17.

Then, at the timing when the head of the image M printed by the print head 14*a* is located actually in the print position of the print head 14*b*, as illustrated in FIG. 20B, the print head 14*b* is still printing the image M−1 and there are R5 lines not yet printed by the print head 14*b*. Likewise, at the timing when the head of the image M−1 printed by the print head 14*a* is located actually in the print position of the print head 14*c*, as illustrated in FIG. 20C, the print head 14*c* is still printing the image M−2 and there are R6 lines not yet printed by the print head 14*c*. Further, at the timing when the head of the image M−2 printed by the print head 14*a* is located actually in the print position of the print head 14*d*, as illustrated in FIG. 20D, the print head 14*d* is still printing the image M−3 and there are R7 lines not yet printed by the print head 14*d*.

Figure 21:
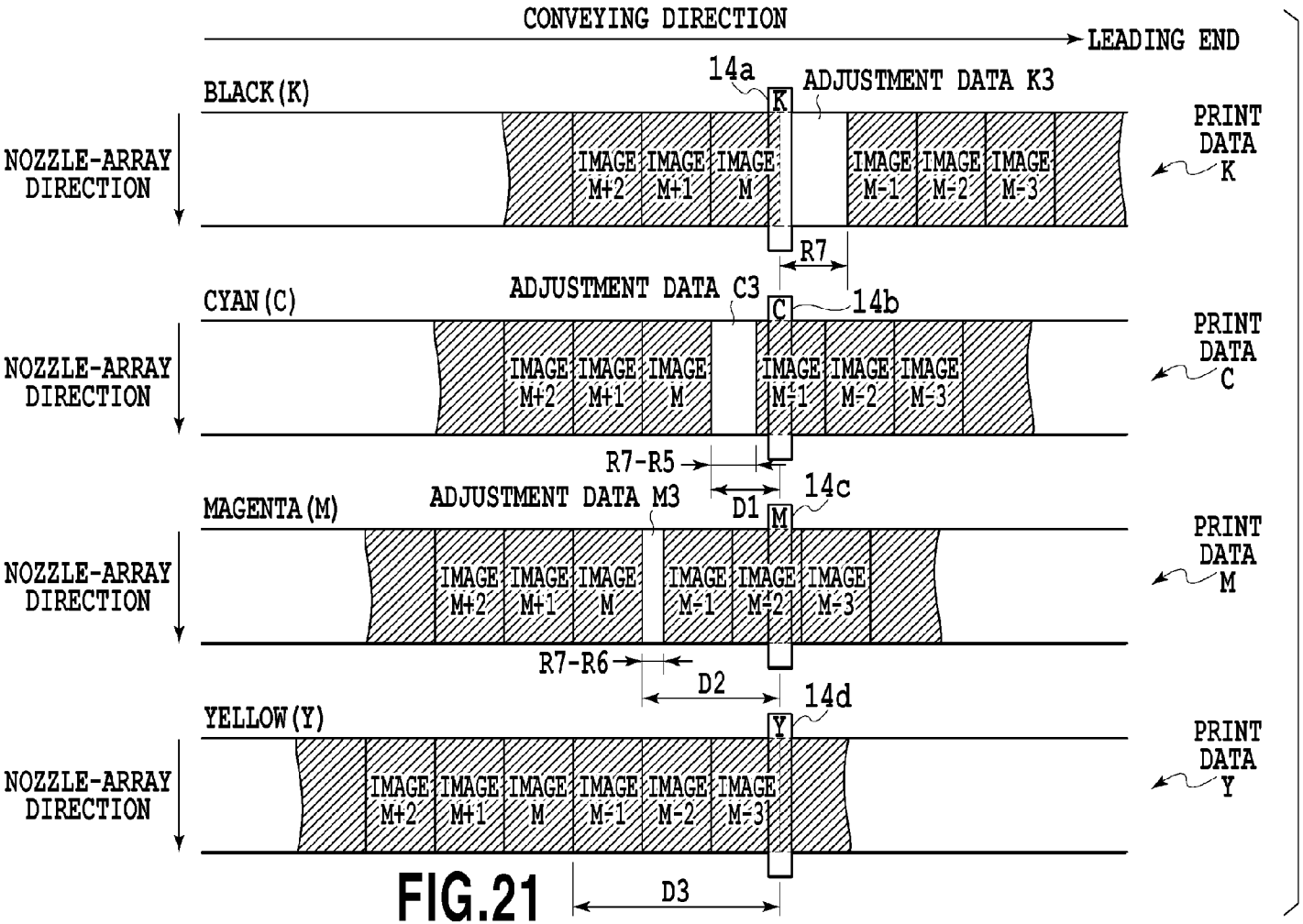
FIG. 21 is a schematic diagram illustrating the state after correction for the states illustrated in FIGS. 20A to 20D.

FIG. 21 is a schematic diagram illustrating the state of bringing print positions of the image M into proper alignment with each other by use of the four print heads after the correction for the state illustrated in FIGS. 20A to 20D. When the CPU 201 determines that the amount of conveyance of the print medium 19 is longer than a desired amount of the conveyance, the adjustment data K3, C3, M3 are added respectively to the print data K, C, M for the print heads 14*a*, 14*b*, 14*c*.

As illustrated in FIG. 21, between the image M−1 and the image M, adjustment data K3 corresponding to R7 lines is added for the print head 14*a*, and adjustment data C3 corresponding to (R7-R5) lines is added for the print head 14*b*. Adjustment data M3 corresponding to (R7-R6) lines is added for the print head 14*c*. The number of lines (R7-R5) of the adjustment data C3 is set to be greater than the number of lines (R7-R6) of the adjustment data M3, while the number of lines R7 of the adjustment data K3 is further greater than the number of lines (R7-R5) of the adjustment data C3.

In this manner, the adjustment data K3, C3, M3 are added respectively to the print data K, C, M. As a result, the print starting positions of the respective print heads 14*a*, 14*b*, 14*c*, 14*d* for the image M are aligned on the print medium, thus correcting the print position shift.

In the present embodiment, when the amount of conveyance of the print medium 19 is shorter than a desired length, the number of lines of adjustment data added to print data for a print head located downstream in the conveying direction is increased to exceed the number of lines of adjustment data added to print data for a print head located upstream in the conveying direction. On the other hand, when the amount of conveyance of the print medium 19 is longer than a desired amount of conveyance, the number of lines of adjustment data added to print data for a print head located upstream in the conveying direction is increased to exceed the number of lines of adjustment data added to print data for a print head located downstream in the conveying direction. In this manner, the number of lines for adding adjustment data (null data) as an adjustment pattern is increased/decreased as needed. This enables alignment of print starting positions of the respective print heads on the print medium, thus correcting the print position shift between print heads (nozzle arrays).

In the present embodiment, the inspection unit located downstream of a plurality of the print heads in the conveying direction detects a pattern for inspecting the amount of the print position shift between print positions printed by a plurality of the print heads located upstream in the conveying direction. By this detection, the amount of the print position shift is acquired and adjustment data having the number of lines corresponding to the amount of the print position shift is added to print data for each print head. Thus, even when the amount of conveyance of the print medium 19 is changed, the print starting position of each nozzle array is capable of being adjusted to correct the shift of a print position in relation to a reference print position.

Figure 22A:
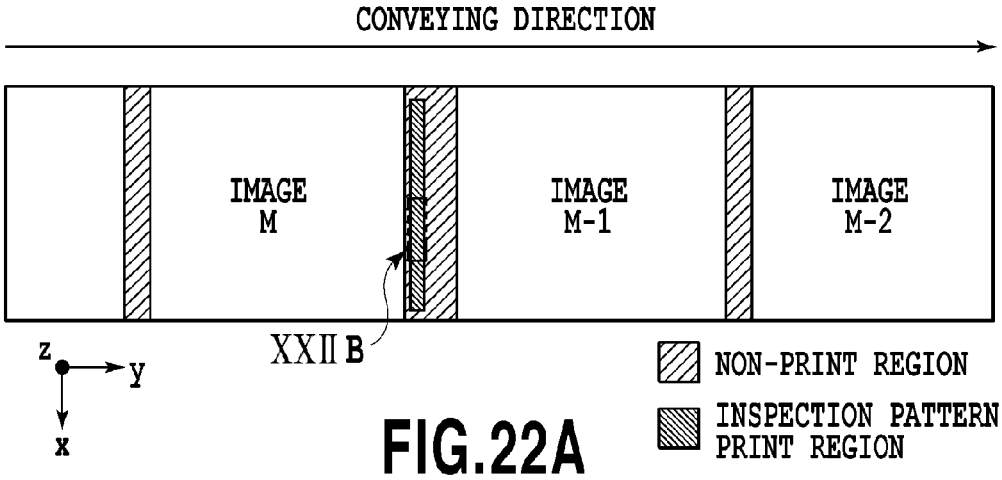
FIG. 22A is a diagram for explaining an inspection pattern.
Figure 22B:
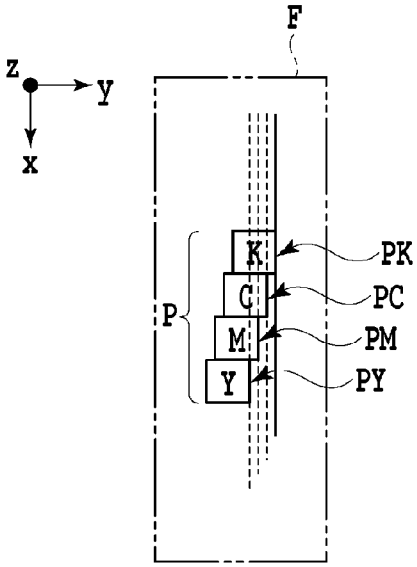
FIG. 22B is a diagram for explaining an example of the configuration of the inspection pattern.

FIGS. 22A and 22B are diagrams for explaining an inspection pattern, wherein FIG. 22A illustrates an example of a print position of the inspection pattern, and FIG. 22B illustrates an example of the configuration of the inspection pattern. As illustrated in FIG. 22A, an inspection pattern is printed in a non-image region between continuous image regions of the print medium 19. In more detail, in the case illustrated in FIG. 22A, an inspection pattern forming region is provided in a non-image region between an image M−1 and an image M, and the inspection pattern is printed in this region. In this manner, in the present embodiment, the inspection patterns are printed in a predetermined interval in the non-image region between the images. The amount of the print position shift (first correction value) is measured by reading this inspection pattern at the inspection unit 5. It should be noted that in FIG. 22A, the inspection pattern printed in the non-image region between the images is illustrated, but the inspection pattern may be printed in the non-image region preceding the image. For example, the inspection pattern may be printed to detect the print position shift, and then the adjustment data for correction of this may be added to start printing an image.

A patch P that is a part of an inspection pattern F illustrated in FIG. 22B includes patches PK, PC, PM, PY. The patch PK shows a patch printed by the nozzle array of a black ink, and the patch PC shows a patch printed by the nozzle array of a cyan ink. The patch PM shows a patch printed by the nozzle array of a magenta ink, and the patch PY shows a patch printed by the nozzle array of a yellow ink. In this case, a shift in print position between nozzle arrays is found by measuring a distance between patches. It should be noted that as long as a shift in a print position of the other print head to the print position of a print head as a reference can be detected, a shape of the inspection pattern and the like are not limited to those illustrated in the figure.

<Change in the Amount of Conveyance of a Print Medium at Double-Sided Printing>

Figure 23:
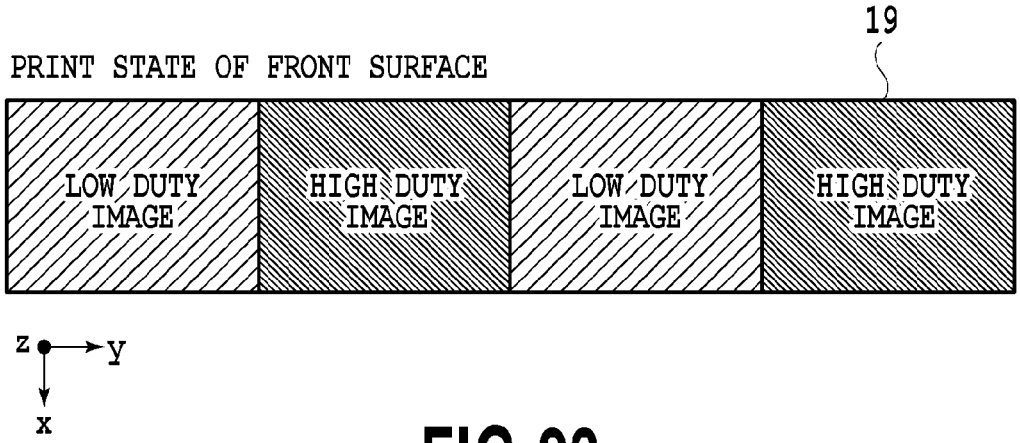
FIG. 23 is a diagram illustrating an example of a print state in the print medium.

FIG. 23 is a diagram illustrating an example of a print state in the print medium 19. As illustrated in FIG. 23, there are some cases where the print duty differs for each region of the print medium 19, such as in the case of an image having a relatively high print duty or an image having a relatively low duty. Further, there are some cases where, depending on a print state of the image (print duty) printed on one surface of the print medium 19, the amount of conveyance of the print medium 19 at the printing on the other surface changes. That is, a friction coefficient between the print medium 19 and the conveying roller when one surface on which ink is not applied comes in contact with the conveying roller differs from a friction coefficient between the print medium 19 and the conveying roller when one surface on which ink is applied comes in contact with the conveying roller to change the amount of conveyance. As described above by referring to the graph in FIG. 6, the print duty on the front surface image has a nearly proportional relationship to the conveying speed at the back surface printing. Specifically, as illustrated in the graph of FIG. 6, there is a tendency that as the print duty of the front surface image is higher, the conveying speed of the print medium at the back surface printing becomes the faster. It should be noted that FIG. 6 illustrates the case of using a dye ink as ink. As described above, the friction coefficient between the print medium and the conveying roller changes according to the print state of the front surface of the print medium and the conveying speed of the print medium changes between the front surface printing and the back surface printing. As a result, there are some cases where an application position of an ink droplet on the print medium, that is, the print position of the ink is shifted from a desired position to degrade the image quality of the back surface.

As illustrated in FIG. 1, there is a distance between the print head 14 and the inspection unit 5, and as illustrated in FIG. 23, the print duty may differ for each region. At the back surface printing, the print position shift detected by reading the inspection pattern at the inspection unit 5 is the print position shift that has occurred in a region prior to a region that will be printed. In the region on which the printing will be performed at the back surface printing, the print position shift occurs under the influence of the print duty of the front surface image corresponding to this region too. Therefore when the line number for the adjustment data is determined based upon the read result of the inspection pattern without considering the print duty of the front surface image corresponding to the region on which the printing will be performed, at the back surface printing, it may be not possible to appropriately correct the shift of the print position.

Therefore in the present embodiment, the line number of the adjustment data to be added to the print data is determined in consideration of a change in conveying speed of the print medium by the influence of the print duty of the front surface image at the back surface printing in the double-sided printing. A specific method thereof will be described later with reference to FIG. 27.

Figure 24A:
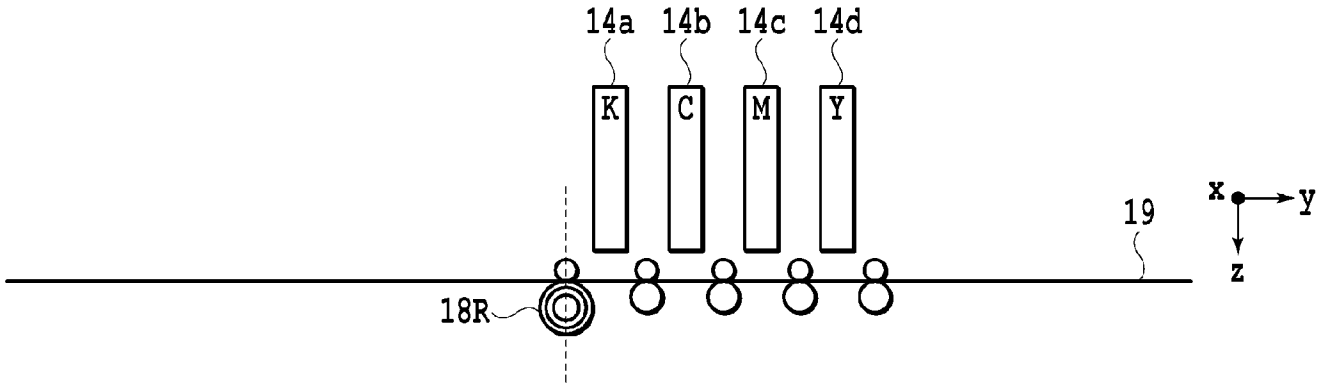
FIG. 24A is a side view illustrating print heads and conveying rollers.
Figure 24B:
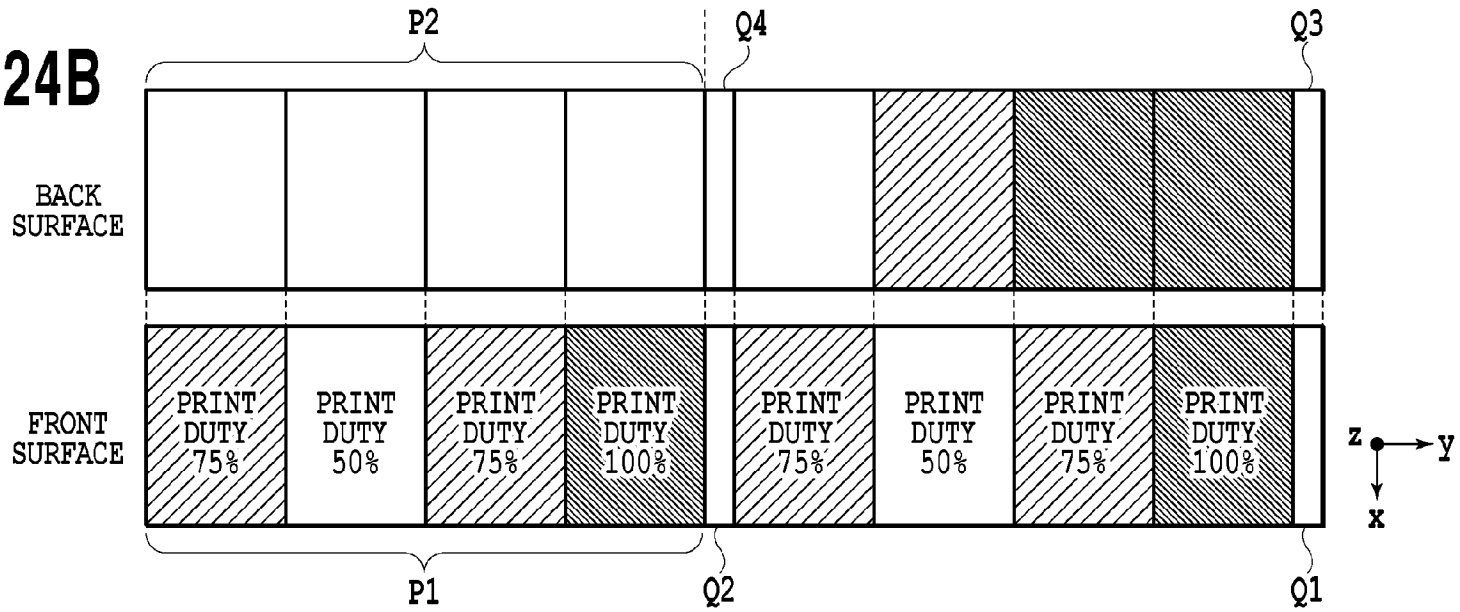
FIG. 24B is a diagram illustrating print data of a front surface image and print data of a back surface image.

FIG. 24A is a side view illustrating the print head 14 and the conveying rollers, and FIG. 24B is a diagram illustrating the print data of the front surface image and the print data of the back surface image.

Figure 13B:
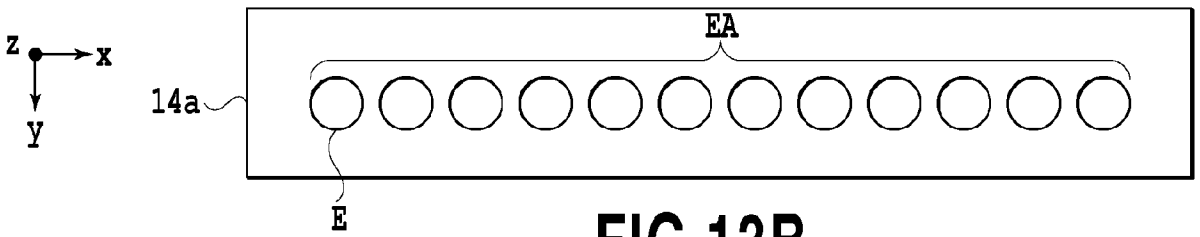
FIG. 13B is a schematic diagram illustrating a nozzle array of the print head.

As illustrated in FIG. 24A and as explained in FIG. 13, the print heads 14*a* to 14*d* are arranged along the conveying direction of the print medium 19 in the printing apparatus 20. As described above, the conveying speed of the print medium 19 changes by a change in friction coefficient between the conveying roller and the print medium 19. Here, the friction coefficient between the conveying roller and the print medium 19 is defined as a friction coefficient between a main conveying roller 18R in a plurality of conveying rollers and the print medium 19. As illustrated in FIG. 24A, the main conveying roller 18R is arranged in a position the closest to the print head 14*a* in the upstream side of the conveying direction, and feeds out the print medium 19 to the print head 14.

In the present embodiment, addition timing of adding the adjustment data is set for every four images. Therefore, as illustrated in FIG. 24B, the adjustment data Q1 to Q4 are added to any of the print data of the front surface image and the print data of the back surface image for every four images. At the printing of the front surface image, the adjustment data Q1, Q2 of the line number according to the read result of the inspection pattern at the front surface printing are added to the print data. At the back surface printing, the adjustment data Q3, Q4 of the line number corresponding to the read result of the inspection pattern at the back surface printing and the print duty of the front surface image are added to the print data.

As described above, the conveying speed of the print medium 19 at the back surface printing changes according to the print duty of the front surface image. Therefore here, the print duties of the front surface image in a predetermined range of the print medium 19 are averaged by the CPU 210, and the averaged value is stored in the RAM 203. At the back surface printing, the CPU 201 reads out the averaged value for use. Here, since the addition timing of the adjustment data is made for every four images, the CPU 201 calculates an average value of the print duties of the four front surface images, and stores the average value in the RAM 203 in order. The print duty of the front surface image corresponding to the region to be printed at the back surface printing is read out from the RAM 203, and the read print duty is used to determine the line number of the adjustment data to be added to the print data of the back surface.

The details will be described later, but in the case illustrated in FIG. 24B, the line number of the adjustment data Q4 is determined based upon a print position shift that has occurred in a region before region P2 obtained from the read result of the inspection pattern and a print duty of region P1 corresponding to region P2.

Figure 25A:
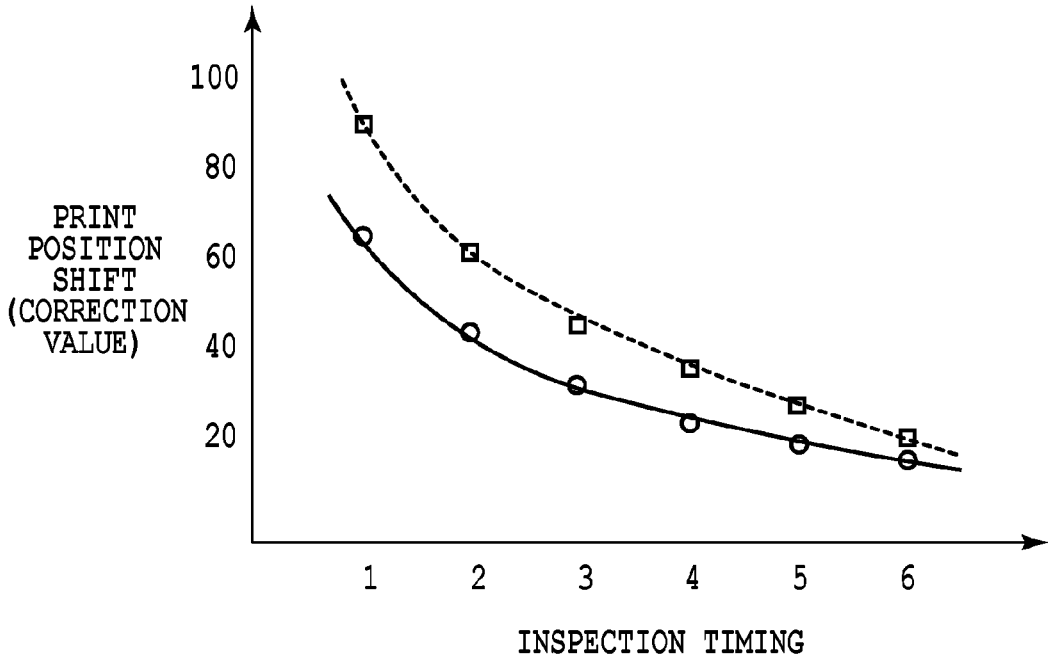
FIG. 25A is a graph illustrating the shift amount of a print position.
Figure 25B:
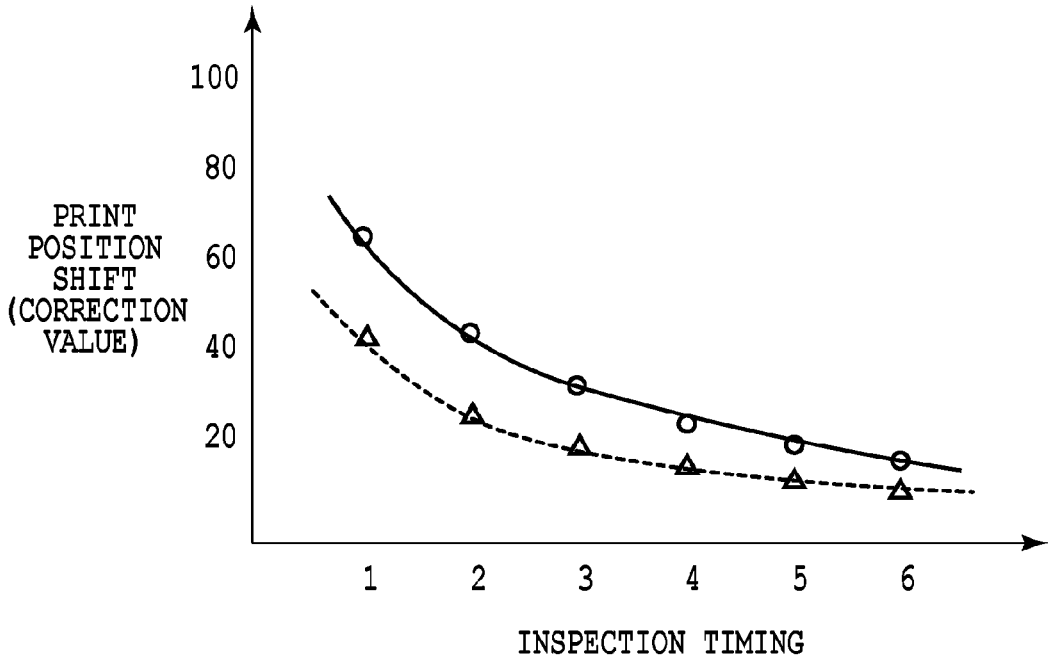
FIG. 25B is a graph illustrating the shift amount of a print position.

FIGS. 25A and 25B are graphs each illustrating the amount of a print position shift corresponding to inspection timing of a print position, wherein a vertical axis indicates a shift of a print position (correction value) on the back surface, and a horizontal axis indicates inspection timing. A circle sign illustrated in FIGS. 25A and 25B indicates a first correction value that is calculated by reading the inspection pattern at the inspection unit 5 and analyzing a shift amount for each inspection timing.

The CPU 201 reads out the print duty of the front surface image corresponding to the back surface from the RAM 203 at the back surface printing, and calculates coefficient α (predetermined value) from a relationship between the print duty and a change in the conveying speed. Here, the corresponding relationship between the print duty of the front surface image and a change in the conveying speed at the back surface printing is in advance found by measuring the conveying speed of the back surface for a constant time for each print duty of the front surface image, and the coefficient α is found from this corresponding relationship. Here, an explanation is made of the case of calculating the coefficient α from the relationship between the print duty of the front surface image and the change in the conveying speed of the print medium, but the coefficient α may be calculated by considering other conditions, such as surrounding conditions (temperature or humidity) in the printing apparatus 20 or the kind of ink. A value found by multiplying the first correction value by the coefficient α is defined as a second correction value. The line number of the adjustment data is determined from the second correction value, and the adjustment data of the determined line number is added to the print data. Here, when the first correction value is indicated at X1 and the second correction value is indicated at X2, the following formula is established.

$$X1 \times \alpha = X2 \quad \text{(Formula 1)}$$

In the present embodiment, in regard to the conveying speed of the print medium at the back surface printing, the conveying speed when the print duty of the front surface is 50% is defined as the center speed. The conveying speed is fast when the print duty of the front surface is higher than 50%, and the conveying speed is slow when the print duty of the front surface is lower than 50%. For example, since the average value of the print duties of the four front surface images respectively having the print duties of 75%, 50%, 75% and 100% is 75%, the conveying speed of the print medium becomes fast at the printing of the back surface. Further, for example, in the case where the average value of the print duties of the front surface image is 25%, the conveying speed of the print medium becomes slow at the printing of the back surface.

In the graph illustrated in FIG. 25A, the second correction value is indicated at a square sign. FIG. 25A illustrates the case where the print duty of the front surface is higher than 50% and the case where the conveying speed of the print medium becomes fast. Therefore, as illustrated in FIG. 25A, the second correction value is larger than the first correction value.

In the graph illustrated in FIG. 25B, the second correction value is indicated at a triangle sign. FIG. 25B illustrates the case where the print duty of the front surface is lower than 50% and the case where the conveying speed of the print medium becomes slow. Therefore, as illustrated in FIG. 25B, the second correction value is smaller than the first correction value.

Here, at the back surface printing, the inspection pattern printed at the printing unit 4 is read at the inspection unit 5 and the shift amount of the print position is found by the read result, and the second correction value is calculated by multiplying the first correction value correcting the print position shift by coefficient α. The line number of the adjustment data to be added to the print data corresponding to each of the print heads 14*a* to 14*d* is determined from the second correction value calculated in this manner. Therefore the adjustment data having the line number determined from the second correction value is added to each of the print heads 14*a* to 14*d*, making it possible to align the print starting positions of the respective print heads 14*a* to 14*d* on the print medium also at the back surface printing.

Figure 26:
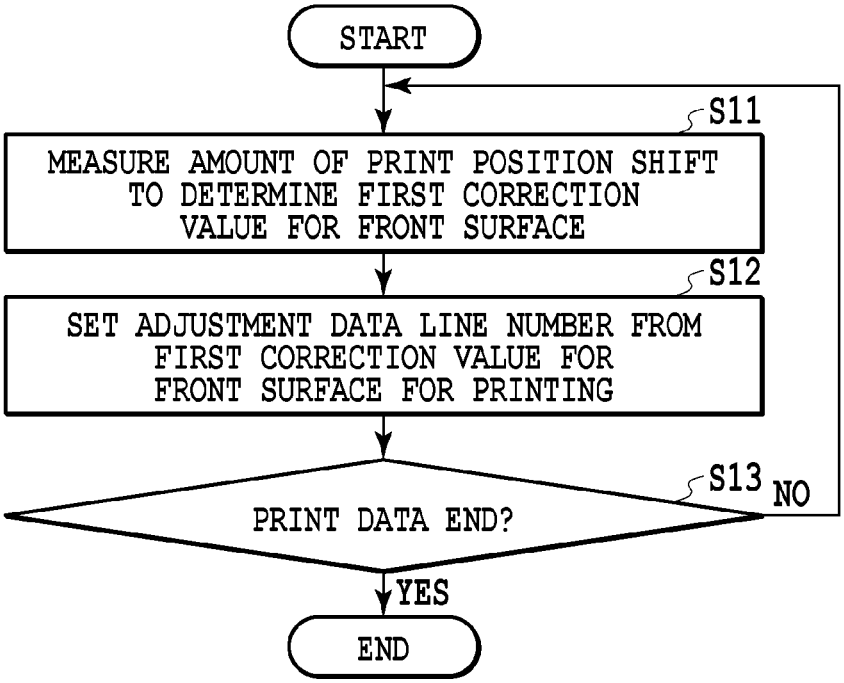
FIG. 26 is a flow chart for explaining a control flow at the printing of a front surface.

Next, an explanation will be made of the control flow in the present embodiment. FIG. 26 is a flow chart for explaining the control flow at the time of printing the front surface image. First, when a print operation is started, an image is printed on the print medium 19 at the printing unit 4, and inspection patterns are printed in a predetermined interval in a non-image region. The inspection pattern is read at the inspection unit 5, and the read result is transmitted to the CPU 201. The CPU 201 measures a shift amount of the print position from the read result of the inspection pattern to determine a first correction value for front surface (S11). The CPU 201 sets the line number of the adjustment data (null data) according to the first correction data for front surface and adds the adjustment data having the set line number to the print data of each of the print heads 14*a* to 14*d*. As a result, the image is printed at the adjusted print timing (S12). The CPU 201 determines whether or not the print data still remains (S13), and in the case where it remains (No in S13), the process goes back to S11, wherein the aforementioned processes are repeated until the print data runs out (S11 to S13). On the other hand, in the case where the print data has end (YES in S13), the print operation ends.

Figure 27:
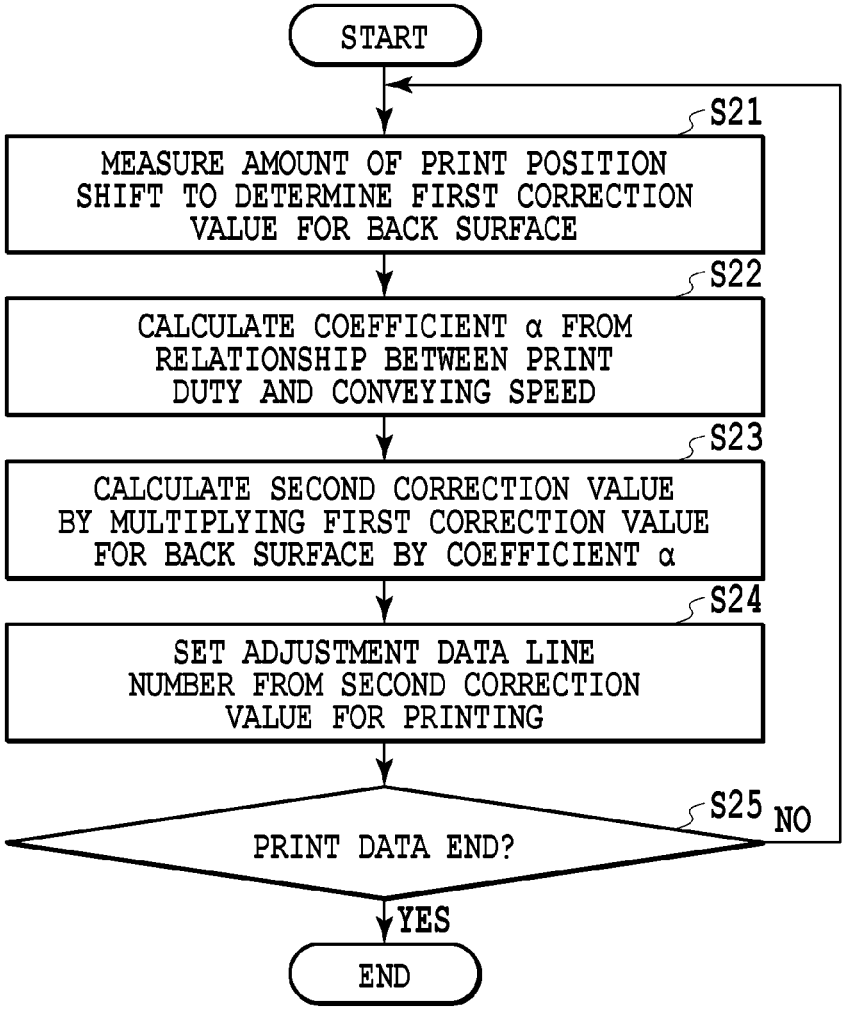
FIG. 27 is a flow chart for explaining a control flow at the printing of a back surface.

FIG. 27 is a flow chart for explaining the control flow at the time of printing the back surface image. When a print operation is started, an image is printed on the print medium 19 at the printing unit 4, and inspection patterns are printed in a predetermined interval in a non-image region. The inspection pattern is read at the inspection unit 5, and the read result is transmitted to the CPU 201. The CPU 201 measures a shift amount of the print position from the read result of the inspection pattern to determine a first correction value for back surface (S21). The CPU 201 calculates coefficient α from a relationship between the print duty of the front surface image and the change in conveying speed of the print medium stored at the RAM 203 (S22). The CPU 201 multiplies the first correction value for back surface found in S21 by the coefficient α calculated in S22 to calculate a second correction value (S23). The CPU 201 sets the line number of the adjustment data according to the second correction data and adds the adjustment data having the set line number to the print data of each of the print heads 14*a* to 14*d* to print an image (S24). The CPU 201 determines whether or not the print data still remains (S25), and in the case where it remains (No in S25), the process goes back to S21, wherein the aforementioned processes are repeated until the print data runs out (S21 to S25). On the other hand, in the case where the print data has end (YES in S25), the print operation ends.

In this manner, at the back surface printing, the shift of the print position is corrected using the second correction value found by multiplying the first correction value for back surface for correcting the print position shift read from the inspection pattern by the coefficient α calculated from the print duty of the front surface image. Thereby even in the case where the friction coefficient between the conveying roller and the print medium changes and the conveying speed of the print medium changes according to the print duty of the front surface image at the back surface printing, it is possible to suppress the shift of the print position due thereto.

Here, the inspection pattern printed by the print head is read, and thereby the amount of the print position shift (first correction value for back surface) in the region before a region that will be printed is detected. The amount of a print position shift (second correction value) in a region that will be printed is estimated based upon the amount of this print position shift and the print duty in the region (region on a surface at the opposite to the surface having the region that will be printed) corresponding to the region that will be printed. The adjustment data of the line number having the pixel number corresponding to the estimated amount of the print position shift is added to the print data to perform a print to the region that will be printed. Therefore at the back surface printing, it is possible to suppress the print position shift due to a change in conveying speed that may be possibly generated in the region that will be printed by the influence of the print duty of the front surface image.

(Third Embodiment)

In the present embodiment, an explanation will be made of the case where a table in which a first correction value, a print duty of the front surface, and a second correction value are associated with each other is in advance stored in the ROM 202. In the second embodiment, the explanation is made of the method for calculating the second correction value by multiplying the first correction value by the coefficient α, but here, an explanation will be made of a method for determining the second correction value using the table for deriving the second correction value. The other components are identical to those in the second embodiment, and therefore the explanation is omitted.

FIG. 28 is a diagram illustrating a table for determining the second correction value. In the table illustrated in FIG. 28, the first correction value, the print duty of the front surface, and the second correction value are associated with each other. This table is used to find the second correction value from the first correction value found based on the inspection pattern and the print duty of the front surface image. In the table illustrated in FIG. 28, for example, in the case where the first correction value is 60 μm and the print duty of the front surface image is 100%, the second correction value of 75 μm is used.

Figure 29:
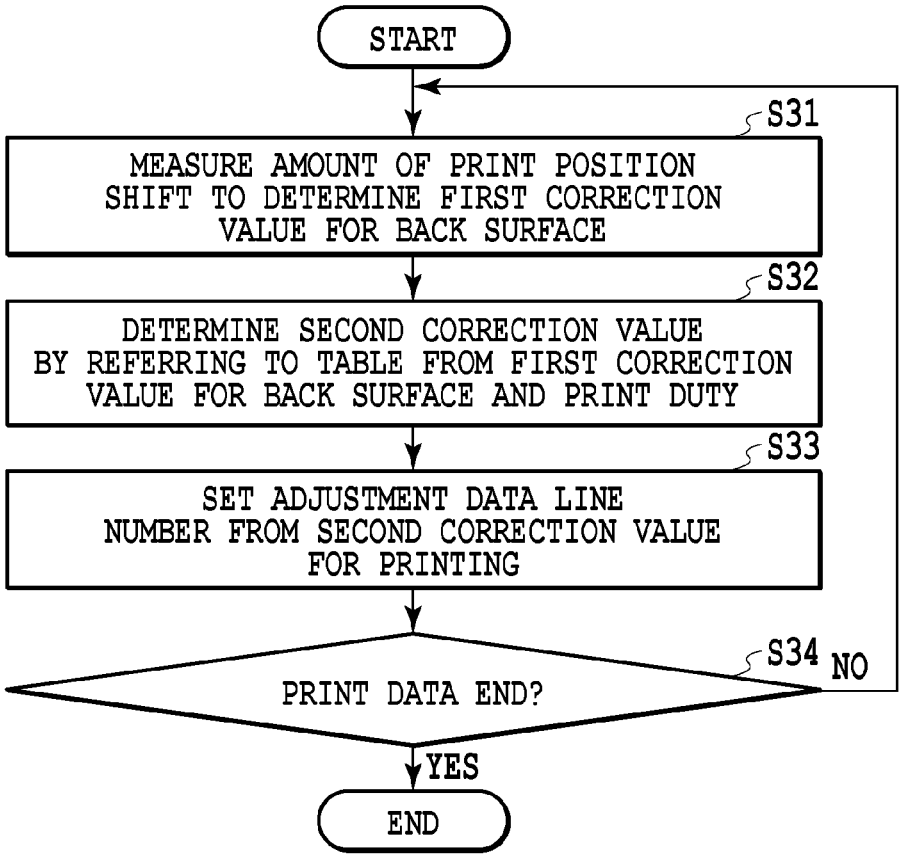
FIG. 29 is a flow chart illustrating a control flow at the printing of a back surface.

FIG. 29 is a flow chart illustrating a control flow at the back surface printing. Since S31 illustrated in FIG. 29 is identical to S21 illustrated in FIG. 27 and S33, S34 illustrated in FIG. 29 are identical to S24, S25 illustrated in FIG. 27, the explanation is omitted. As illustrated in FIG. 29, in the present embodiment, the second correction value is determined by referring to the table according to the first correction value found in S31 and the print duty of the front surface (S32). In this manner, here, the table in which the first correction value, the print duty of the front surface image, and the second correction value are associated with each other is in advance stored in the ROM 202, and therefore the second correction value can be found by referring to this table, and then is used to correct the print position shift.

Figure 30:
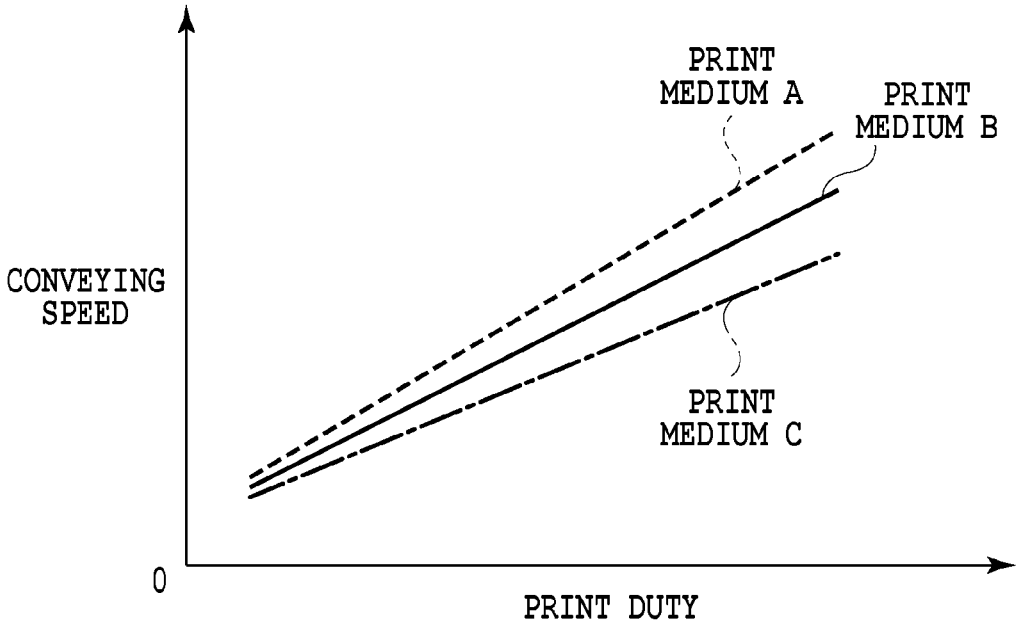
FIG. 30 is a graph illustrating a relationship between a print duty of a front surface and a change in conveying speed.

FIG. 30 is a graph illustrating a relationship between a print duty of the front surface image and a change in conveying speed of the print medium for each kind of the print medium. The graph illustrated in FIG. 30 illustrates a relationship between the print duty of the front surface and the conveying speed of the print medium in the case where print medium A, print medium B, and print medium C that are different in kind (material or processing) from each other are used as the print mediums. As illustrated in FIG. 30, the print mediums A, B, and C respectively have different inclinations. When the print mediums differ thus in kind from each other, there are some cases where the degree of the permeation of ink differs depending on the kind of the print medium, and therefore a change in conveying speed of the print medium at the back surface printing differs even if the print duty of the front surface image is the same with each other. That is, in some case the relationship between the print duty of the front surface image and the change in conveying speed of the print medium at the back surface printing differs depending on the kind of the print medium. Therefore, in the case of using a plurality of kinds of print mediums in the printing apparatus 20, it is preferable to prepare a table for finding the second correction value for each kind of the print medium in use.

In addition, when an ink component ratio between dye inks of the respective colors used in printing differs, the friction coefficient between the print medium and the conveying roller differs for each color. As a result, the relationship between the print duty of the front surface and the change in conveying speed of the print medium differs for each color. Therefore a table for finding the second correction value may be prepared for each ink color used in the printing apparatus 20.

(Fourth Embodiment)

In the present embodiment, a pigment ink is used as ink. In the case of using the dye ink as in the case of the second embodiment, when the dye ink is applied on the print medium, the applied dye ink is permeated into the print medium. In contrast, when the pigment ink is applied on the print medium, the applied pigment ink is accumulated on the print medium. The details will be described later by referring to FIG. 31, and this difference causes a relationship of a change in conveying speed at the back surface printing to a print duty of the front surface image to differ between the case of using the pigment ink and the case of using the dye ink. Therefore a value of coefficient α for finding the second correction value is different from that of the second embodiment using the dye ink. Since the other components are identical to those in the second embodiment, the explanation is omitted.

Figure 31:
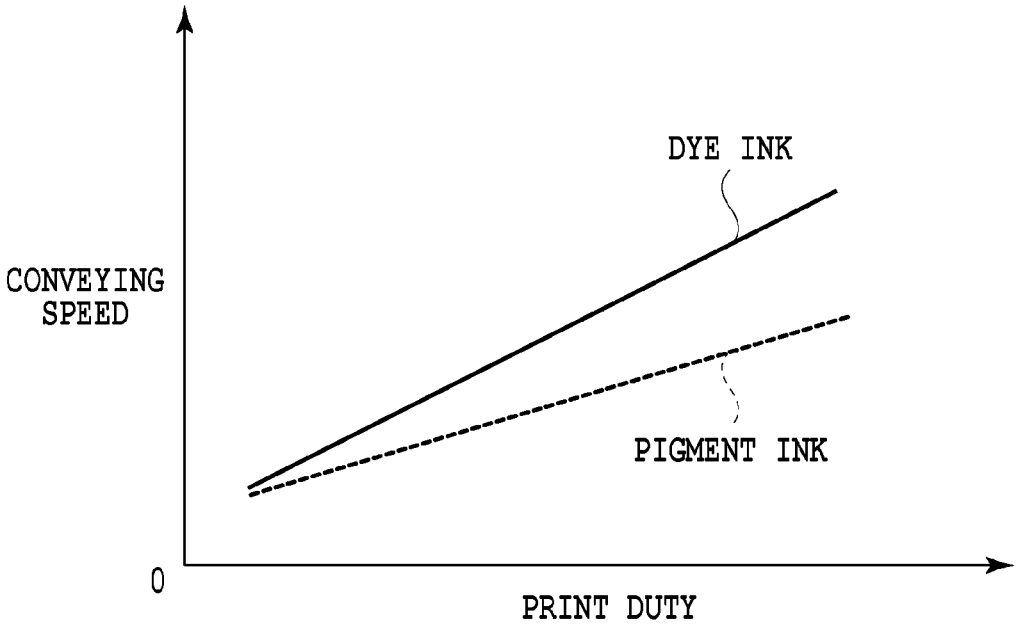
FIG. 31 is a graph illustrating a relationship between a print duty of a front surface and a change in conveying speed.

FIG. 31 is a graph illustrating a relationship between a print duty of the front surface and a change in conveying speed of the print medium in the case of using the pigment ink and in the case of using the dye ink. As illustrated in FIG. 31, in the case of using any ink, as the print duty is higher, the friction coefficient between the print medium and the conveying roller is the higher to increase the conveying speed, but a ratio of the change differs for each ink. In more detail, as illustrated in FIG. 31, the inclination in the case of using pigment ink is more gradual than that in the case of using the dye ink. In the present embodiment, the corresponding relationship between the print duty of the front surface image and the change in conveying speed at the back surface printing in the case of using the dye ink is in advance found, and coefficient α is calculated by using the data indicating this corresponding relationship. By thus calculating the coefficient α corresponding to each kind of ink, the print position shift can be suppressed with the second correction value suitable for each kind of ink.

(Fifth Embodiment)

In the present embodiment, an additional value β (predetermined value) calculated from a print duty of the front surface image is added to a first correction value to find a second correction value. The other components are identical to those in the second embodiment, and therefore the explanation is omitted.

Figure 32A:
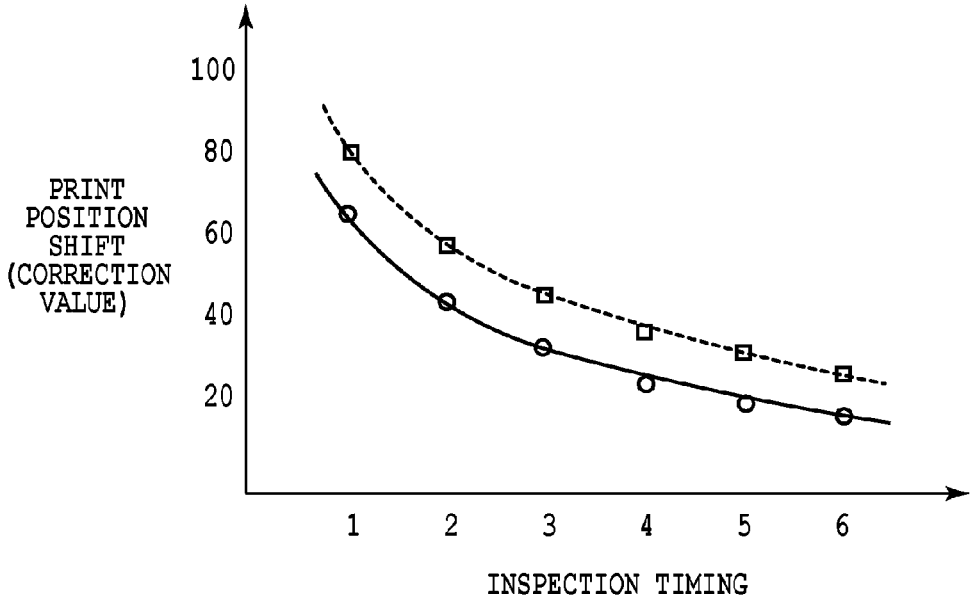
FIG. 32A is a graph illustrating the shift amount of a print position.
Figure 32B:
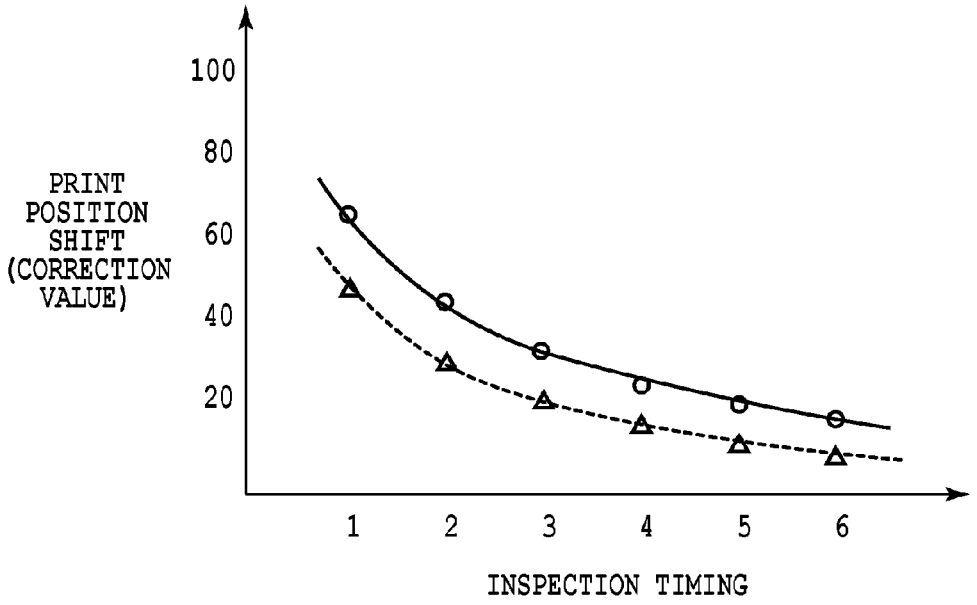
FIG. 32B is a graph illustrating the shift amount of a print position.

FIGS. 32A and 32B are graphs each illustrating the shift amount of a print position corresponding to inspection timing of a print position, wherein a vertical axis indicates a shift of a print position (correction value) on the back surface, and a horizontal axis indicates inspection timing. A circle sign illustrated in FIGS. 32A and 32B indicates a first correction value that is calculated by reading an inspection pattern at the inspection unit 5 and analyzing a shift amount for each inspection timing.

The CPU 201 reads out a print duty of the front surface corresponding to the back surface from the RAM 203 at the back surface printing, and calculates the additional value β based on a relationship between the print duty and a change in conveying speed. Here, the corresponding relationship between the print duty of the front surface image and the change in conveying speed at the back surface printing is in advance found by measuring the conveying distance of the back surface in a constant time for each print duty of the front surface image. The additional value β is found from the data indicating this corresponding relationship. A value found by multiplying the first correction value by the additional value β is defined as a second correction value. The line number of the adjustment data is determined according to the second correction value, and the adjustment data of the determined line number is added to the print data. Here, when the first correction value is indicated at X1 and the second correction value is indicated at X2, the following formula is established.

$$X1+\beta=X2 \quad \text{(Formula 2)}$$

As similar to the second embodiment, in the conveying speed of the print medium at the back surface printing, the conveying speed when the print duty of the front surface is 50% is defined as the center speed. The conveying speed becomes fast when the print duty of the front surface is higher than 50%, and the conveying speed becomes slow when the print duty of the front surface is lower than 50%. For example, since the average value of the print duties of the four front surface images having the print duties of 75%, 50%, 75% and 100% is 75%, the conveying speed of the print medium becomes fast upon printing the back surface. For example, in the case where the average value of the print duties of the front surface image is 25%, the conveying speed of the print medium becomes slow upon printing the back surface.

In the graph illustrated in FIG. 32A, the second correction value is indicated at a square sign. FIG. 32A illustrates the case where the print duty of the front surface is higher than 50% and the case where the conveying speed of the print medium becomes fast. Therefore, as illustrated in FIG. 32A, the second correction value is larger than the first correction value.

In the graph illustrated in FIG. 32B, the second correction value is indicated at a triangle sign. FIG. 32B illustrates a case where the print duty of the front surface is lower than 50% and a case where the conveying speed of the print medium becomes slower. Therefore, as illustrated in FIG. 32B, the second correction value is smaller than the first correction value.

Figure 33:
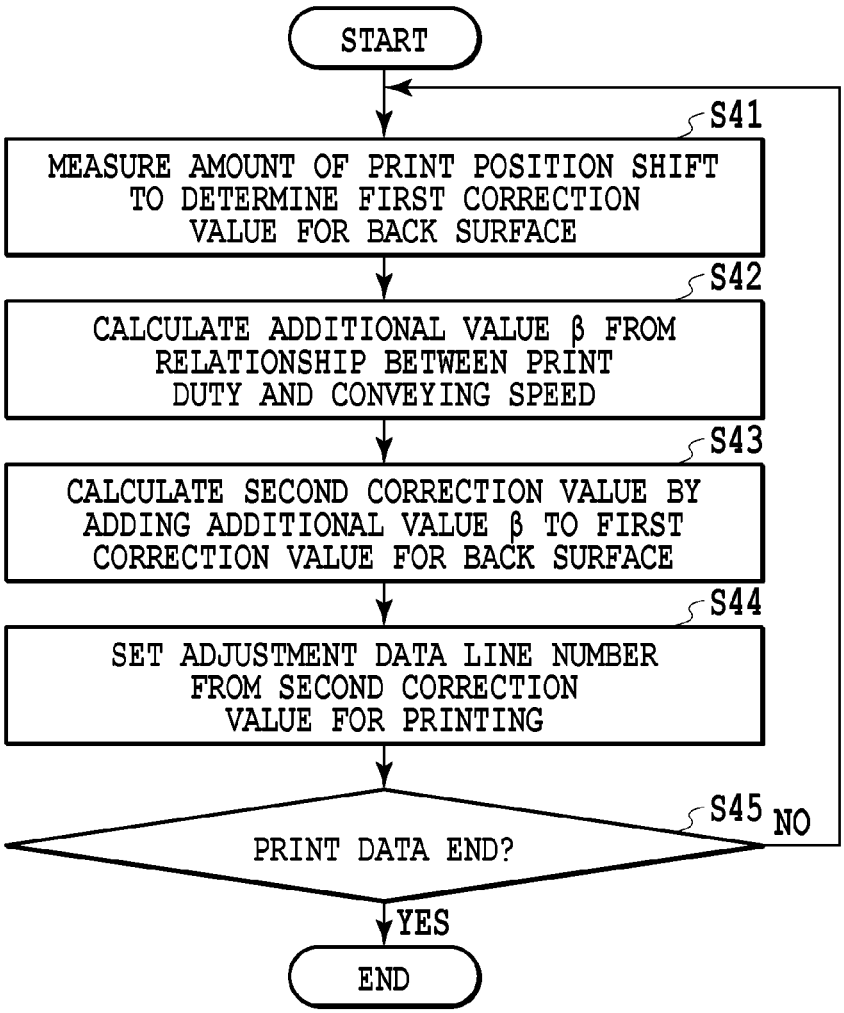
FIG. 33 is a flow chart illustrating a control flow at the printing of a back surface.

FIG. 33 is a flow chart illustrating a control flow at the back surface printing. Since S41 illustrated in FIG. 33 is identical to S21 illustrated in FIG. 27 and S44, S45 illustrated in FIG. 33 are identical to S24, S25 illustrated in FIG. 27, the explanation is omitted. As illustrated in FIG. 33, in the present embodiment, an additional value β is calculated from a first correction value found in S41 and a print duty of the front surface (S42). Next, the additional value β calculated in S42 is added to the first correction value found in S41 to find a second correction value (S43). It is possible to suppress the print position shift due to a change in conveying speed by the influence of the print duty of the front surface at the back surface printing even in the case of setting the line number of the adjustment data using the second correction value found in this manner.

(Other Embodiments)

In the aforementioned embodiments, the case of using the plurality of print heads is explained, but the present invention may be applied also to the case of using a single print head. That is, even in the case of using the single print head, the shift amount of a print position to a desired print position is found, and the shift amount of the print position that will possibly be generated is estimated from the found shift amount of the print position and a change in conveying speed to be estimated from a print duty of the front surface image. Non-image data having the line number of the pixel number corresponding to the estimated shift amount of the print position is added to print data. Then an image is printed based upon the print data to which the non-image data having the adjusted line number is added. In this case also, it is possible to suppress the shift of the print position due to the change in conveying speed by the influence of the print duty of the front surface image. It should be noted that in the case of using the single print head, the amount of the print position shift (first correction value) is found by causing the print head to print patterns in a constant interval, reading the printed pattern at an inspection unit and comparing this constant interval with the actually printed pattern interval. The other method may be used to find the shift amount of the print position. In addition, the kinds of the ink colors that can be used are also not limited to the explained kinds. For example, the print heads that eject ink of the same color or the print heads that eject various processing liquids may be used. Further, a color material other than the ink may be applied to the print medium from the print head.

In the second to fifth embodiments, the method for correcting the print position shift by adding the adjustment data of the line number corresponding to the shift amount of the print position to the print data is explained. However, the method for correcting the shift of the print position is not limited thereto. For example, as in the case of the first embodiment, the ejection timing of the ink at the time of printing the image on the back surface may be controlled by changing the drive cycle of the print element at the back surface printing according to the print duty of the front surface image.

In the aforementioned embodiments, the case where the factor of changing the conveying speed of the print medium is the print duty of the front surface image or the like is explained. However, there are some cases where the conveying speed of the print medium changes also by a condition other than the above condition. For example, there are some cases where the conveying speed changes also according to print conditions such as the time from a point where ink is applied on one surface to a point where ink is applied on the other surface, and humidity or temperature in the printing apparatus. Even in this case, it is possible to calculate a print clock correction value also in consideration of such print conditions by adding information in regard to a change in conveying speed by the above print condition to the conveying speed changing information illustrated in FIG. 9. By ejecting ink according to the print clock corrected using the print clock correction value, the print position shift due to the above print condition can be suppressed.

In the aforementioned embodiments, the method for controlling the ejection timing by the CPU 50 in the printing apparatus 20 or the print head controller 53 is explained, but the ejection timing may be controlled by an external device (for example, computer).

It should be noted that in the aforementioned embodiments, the printing apparatus of the inkjet system is explained, but, for example, the present invention may be applied also to a printing apparatus of another printing system such as a printing apparatus of a thermal transfer system.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-067118, filed Mar. 27, 2014, and No. 2014-140274, filed Jul. 8, 2014, which are hereby incorporated by reference wherein in their entirety.

What is claimed is:

1. A printing apparatus comprising:

a conveying unit configured to convey a print medium using a roller;

a print head configured to apply a color material on a first surface of the print medium and a second surface of the print medium, which is a surface opposite to the first surface, as the print medium is conveyed by the conveying unit in a predetermined conveying direction;

an obtaining unit configured to obtain information on an application amount of the color material applied on the first surface of the print medium; and a control unit configured to control timing of applying a color material on an area of the second surface on which printing is to be performed according to the application amount for a portion of the first surface that comes in contact with the roller at the time of performing printing on the area of the second surface, the application amount being indicated by the information obtained by the obtaining unit, wherein the control unit controls timing of applying the color material so that an interval of applying timings of the color material in a case that the application amount is a first application amount is shorter than an interval of applying timings of the color material in a case that the application amount is a second application amount that is less than the first application amount.

2. The printing apparatus according to claim 1, wherein the print head includes a print element, and the control unit controls the interval of the timings to be shorter by changing a drive cycle of the print element.

3. The printing apparatus according to claim 1, wherein the control unit controls the interval of the timings in response to a print clock corrected using a print clock correction value for correcting the interval of the timings according to the print condition of the first surface.

4. The printing apparatus according to claim 3, wherein the control unit uses a table in which an application amount of the color material to be applied on the first surface is associated with information in regard to the print clock correction value to find the print clock correction value, corrects a print clock using the found print clock correction value, and controls the interval of the timings in response to the corrected print clock.

5. The printing apparatus according to claim 4, wherein the control unit finds the print clock correction value for each unit region on the second surface corresponding to a unit region in the conveying direction on the first surface according to an application amount of a color material for each unit region to be applied on the first surface, corrects a print clock corrected using the found print clock correction value, and controls the interval of the timings for each unit region in response to the corrected print clock.

6. The printing apparatus according to claim 4, wherein the control unit controls the interval of the timings by making the drive cycle shorter as the application amount of the color material increases.

7. The printing apparatus according to claim 1, wherein the printing head ejects ink onto the print medium as the color material from nozzles arranged in a direction crossing the conveying direction.

8. A printing apparatus comprising:

a conveying unit configured to convey a print medium using a roller;

a print head configured to apply a color material on a first surface of the print medium and a second surface of the print medium, which is a surface opposite to the first surface, as the print medium is conveyed by the conveying unit in a predetermined conveying direction;

an obtaining unit configured to obtain information on an application amount of the color material applied on the first surface of the print meduim;

a control unit configured to control timing of applying a color material on an area of the second surface on which printing is to be performed according to the application amount for a portion of the first surface that comes in contact with the roller at the time of performing printing on the area of the second surface, the application amount being indicated by the information obtained by the obtaining unit, a detecting unit configured to detect a first shift amount in an application position of the color material from the print head at the printing on the second surface after the printing on the first surface; and an estimating unit configured to estimate a second shift amount of an application position of the color material from the print head based upon the first shift amount and an application amount of a color material unit region applied on the first surface, in the case where the first surface comes in contact with the roller at the time of performing printing on the second surface, wherein the control unit controls timing of applying the color material on the print medium from the print head according to the second shift amount upon printing on the second surface.

9. The printing apparatus according to claim 8, wherein the control unit controls the timing by adding non-image data having the pixel number corresponding to the second shift amount to the print data of the print head, in which the greater the application amount, the smaller an amount of the added non-image data, to make the interval of the timings of the applying the color material shorter.

10. The printing apparatus according to claim 8, wherein the print head includes a print element, and the control unit controls the timing by changing a drive cycle of the print element according to the second shift amount.

11. The printing apparatus according to claim 8, wherein the print head prints an inspection pattern by adding a color material on the print medium, and the detecting unit detects the first shift amount by reading the inspection pattern.

12. The printing apparatus according to claim 8, wherein the print head includes a plurality of print heads, the plurality of print heads are respectively arranged in different position in the conveying direction, and the first shift amount is a shift amount of an application position of the other print heads to an application position of a reference print head among the plurality of print heads.

13. The printing apparatus according to claim 8, wherein the estimating unit estimates the second shift amount by using a predetermined value calculated from a relationship between the application amount of the color material and the change in conveying speed at the printing on the second surface.

14. The printing apparatus according to claim 8, wherein the estimating unit estimates the second shift amount by referring to a table in which the first shift amount, the application amount of the color material, and the second shift amount are associated with each other.

* * * * *